US008593385B2

(12) United States Patent
Lee et al.

(10) Patent No.: US 8,593,385 B2
(45) Date of Patent: Nov. 26, 2013

(54) DISPLAY DEVICE COMPRISING COLOR PIXELS CONNECTED TO GATE DRIVERS AND DRIVING METHOD THEREOF

(75) Inventors: Jae Hoon Lee, Seoul (KR); Whee-Won Lee, Busan (KR); Duc-Han Cho, Incheon (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 13/357,780

(22) Filed: Jan. 25, 2012

(65) Prior Publication Data

US 2012/0307174 A1 Dec. 6, 2012

(30) Foreign Application Priority Data

Jun. 3, 2011 (KR) ..... 10-2011-0053970

(51) Int. Cl.
*G09G 3/36* (2006.01)

(52) U.S. Cl.
USPC ..... 345/88; 345/83; 345/100

(58) Field of Classification Search
USPC ..... 345/1.1–111, 156–184, 204–215, 345/690–699, 901–905, 76–104
See application file for complete search history.

(56) References Cited

U.S. PATENT DOCUMENTS 6,184,853 B1 * 2/2001 Hebiguchi et al. ..... 345/88
7,852,446 B2 * 12/2010 Kim ..... 349/143
7,868,861 B2 * 1/2011 Cho et al. ..... 345/87
8,115,718 B2 * 2/2012 Chen et al. ..... 345/95
2006/0238134 A1 * 10/2006 Park et al. ..... 315/169.3
2008/0191980 A1 * 8/2008 Jeon ..... 345/87
2008/0238844 A1 10/2008 Kakiuchi et al.
2010/0085348 A1 * 4/2010 Bae et al. ..... 345/213
2010/0156947 A1 * 6/2010 Moon et al. ..... 345/690

FOREIGN PATENT DOCUMENTS

JP 09325738 A 12/1997
JP 2006189810 A 7/2006
KR 1020050069101 A 7/2005
KR 1020060018002 A 2/2006
KR 1020070047439 A 5/2007
KR 1020070060660 A 6/2007
KR 1020070081164 A 8/2007
KR 1020080028079 A 3/2008
KR 1020080049445 A 6/2008
KR 102010021234 A 2/2010
KR 1020100033575 A 3/2010
KR 1020100034826 A 4/2010

* cited by examiner

*Primary Examiner* — Amare Mengistu
*Assistant Examiner* — Gloryvid Figueroa-Gibson
(74) *Attorney, Agent, or Firm* — Cantor Colburn LLP

(57) ABSTRACT

Disclosed are a display device and a driving method thereof. The display device includes: a display panel including a plurality of pixels, a plurality of gate lines, and a plurality of data lines; a first gate driver and a second gate driver which each transmit a gate signal to the gate lines and are at edge regions of the display panel; and a data driver which transmit data voltages to the data lines. The pixels include a plurality of first color pixels which display a first color and are connected to the first gate driver, a plurality of second color pixels which display a second color and are connected to the second gate driver, and a plurality of third color pixels which display a third color and comprise at least a pixel connected to the first gate driver and at least a pixel connected to the second gate driver.

23 Claims, 19 Drawing Sheets

DISPLAY DEVICE COMPRISING COLOR PIXELS CONNECTED TO GATE DRIVERS AND DRIVING METHOD THEREOF

This application claims priority to Korean Patent Application No. 10-2011-0053970, filed on Jun. 03, 2011, and all the benefits accruing therefrom under 35 U.S.C. §119, the content of which in its entirety is herein incorporated by reference.

BACKGROUND OF THE INVENTION (1) Field of the Invention

The disclosure relates to a display device and a driving method thereof.

(2) Description of the Related Art

A display device includes a pixel electrode, a plurality of pixels including a switching element connected thereto, and a plurality of signal lines such as a gate line, or a data line, to apply a voltage to the pixel electrode by controlling the switching element. The gate line transmits a gate signal generated by a gate driving circuit and the data line transmits a data voltage generated by a data driving circuit. The switching element transmits the data voltage to the pixel electrode according to the gate signal.

The gate driving circuit and the data driving circuit, which are implemented in an integrated circuit ("IC") chip, are directly mounted on a display panel or mounted on a flexible circuit film, for example, but is not limited thereto, to be attached to the display panel. However, the IC chip constitutes a higher percentage of a manufacturing cost of the display device. Particularly, in a case of a data driving IC chip, the cost is very higher as compared with a gate driving IC chip, such that in a case of a high-resolution display device, the number of the data driving IC chips needs to be reduced. The gate driving circuit can be integrated on the display panel together with the gate line, the data line, and the switching element, such that the cost may be reduced. However, the data driving circuit has a relatively complicated structure and thus is difficult to be integrated on the display panel. Therefore, there is a greater demand for a technique to reduce the number of the data driving circuit.

BRIEF SUMMARY OF THE INVENTION

An embodiment of the invention has been made in an effort to provide a display device having advantages of reducing the number of data driving circuit chips installed on the display device, ensuring a sufficient space for integrating gate driving circuits, and reducing a display defect such as a horizontal line defect.

An exemplary embodiment of the invention provides a display device including: a display panel including a plurality of pixels arranged in a matrix form, a plurality of gate lines which extend in a row direction, and a plurality of data lines which cross the plurality of gate lines; a first gate driver and a second gate driver which each transmit a gate signal to the plurality of the gate lines and are at edge regions of the display panel which face each other; and a data driver which transmits data voltages to the plurality of the data lines, in which the plurality of the pixels include a plurality of first color pixels which displays a first color, a plurality of second color pixels which displays a second color, and a plurality of third color pixels which displays a third color, the first through the third colors being different from one another, and the plurality of the first color pixels are connected to the first gate driver, the plurality of the second color pixels are connected to the second gate driver, and the plurality of the third color pixels include at least a pixel connected to the first gate driver and at least a pixel connected to the second gate driver.

Another exemplary embodiment of the invention provides a driving method of a display, the method including: applying a gate-on voltage to a plurality of first color pixels of a display panel which displays a first color, through a gate line connected with the first color pixels and extending in a row direction, by using a first gate driver at a first edge region of the display panel; applying a gate-on voltage to a plurality of second color pixels of the display panel which displays a second color, through a gate line connected with the second color pixels and extending in the row direction, by using a second gate driver at a second edge region of the display panel; and applying, alternately or simultaneously, a gate-on voltage to a plurality of third color pixels of the display panel which displays a third color, through a gate line connected with the third color pixels and extending in the row direction, by using the first gate driver and the second gate driver, wherein the first through the third colors are different from one another, and wherein the display panel includes: a plurality of pixels arranged in a matrix form, a plurality of gate lines extending in the row direction, and a plurality of data lines crossing the plurality of gate lines; the first gate driver and the second gate driver which each transmit a gate signal to the plurality of the gate lines and are at the first and second edge regions which face each other; and a data driver which transmits data voltages to the plurality of the data lines.

Still another exemplary embodiment of the invention provides a display panel including: a plurality of pixels arranged in a matrix form, the matrix including first rows of pixels which each display a first color, second rows of pixels which each display a second color, and third rows of pixels which each display a third color, the first through the third colors being different from one another; a plurality of data lines which each extend in a first direction and transmits data voltages; and a plurality of gate lines which each extend in a second direction substantially perpendicular to the first direction and transmits a gate signal to the plurality of the pixels, wherein gate signals are transmitted in a same direction with respect to the first or the second rows of the pixels which display the first or the second color.

The plurality of the third color pixels may be alternately connected to the first gate driver and the second gate driver.

The first gate driver may include a plurality of first gate driving circuits sequentially connected to each other in a column direction and which sequentially transmit a gate-on voltage, the second gate driver may include a plurality of second gate driving circuits sequentially connected to each other in the column direction and which sequentially transmit a gate-on voltage, and the plurality of the first gate driving circuits and the plurality of the second gate driving circuits may alternately transmit the gate-on voltage.

A gate line connected with the first color pixels, a gate line connected with the second color pixel, and a gate line connected with the third color pixel may be alternately disposed along the column direction in the order named, and when $k=6j+1$ ($j=0$ or a positive integer) is defined, the method may further include sequentially applying to the plurality of the data lines data voltages for the first color pixel in a k-th row, the second color pixel in a (k+1)-th row, the first color pixel in a (k+3)-th row, the third color pixel in a (k+2)-th row, the third color pixel in a (k+5)-th row and the second color pixel in a (k+4)-th row in the order named, by using the data driver.

A gate line connected with the third color pixel, a gate line connected with the first color pixel, and a gate line connected with the second color pixels may be alternately disposed along the column direction in the order named, and when k=6j+1 (j=0 or a positive integer) is defined, the method may further include sequentially applying to the plurality of the data lines data voltages for the third color pixel in a k-th row, the first color pixel in a (k+1)-th row, the second color pixel in a (k+2)-th row, the third color pixel in a (k+3)-th row, the second color pixel in a (k+5)-th row and the first color pixel in a (k+4)-th row in the order named, by using the data driver.

A gate line connected with the first color pixels, a gate line connected with the third color pixels, and a gate line connected with the second color pixels may be alternately disposed along the column direction in the order named, and when k=6j+1 (j=0 or a positive integer) is defined, the method may further include sequentially applying to the plurality of the data lines data voltages for the first color pixel in a k-th row, the third color pixel in a (k+1)-th row, the first color pixel in a (k+3)-th row, the second color pixel in a (k+2)-th row, the third color pixel in a (k+4)-th row, and the second color pixel in a (k+5)-th row in the order named, by using the data driver.

The first gate driving circuits and the second gate driving circuits may be integrated to the display panel, and a column direction width of a space on the display panel where a first gate driving circuit or a second gate driving circuit is integrated may correspond to a column direction width of two pixel rows.

A gate line connected with the third color pixel may be connected to both the first gate driver and the second gate driver.

Adjacent data lines of the plurality of the data lines may transmit the data voltages having different polarities.

The pixels may include switching elements connected to the gate lines and the data lines, and the switching elements of the plurality of the pixels disposed at one pixel column may be alternately connected to different data lines every two pixel rows.

The pixels may include switching elements connected to the gate lines and the data lines, and the switching elements of the plurality of the pixels disposed at one pixel column may be alternately connected to different data lines at every pixel row.

All the gate lines connected with the pixels which display the first color may be connected to the first gate driver, all the gate lines connected with the pixels which display the second color may be connected to the second gate driver, and the gate lines connected with the pixels which display the third color may be alternately or simultaneously connected to the first and the second gate drivers, thereby removing the display defect such as a visible horizontal line defect.

BRIEF DESCRIPTION OF THE DRAWINGS

The above and other aspects, advantages and features of the invention will become more apparent by describing in further detail exemplary embodiments thereof with reference to the accompanying drawings, in which.

DETAILED DESCRIPTION OF THE INVENTION

Figure 1:
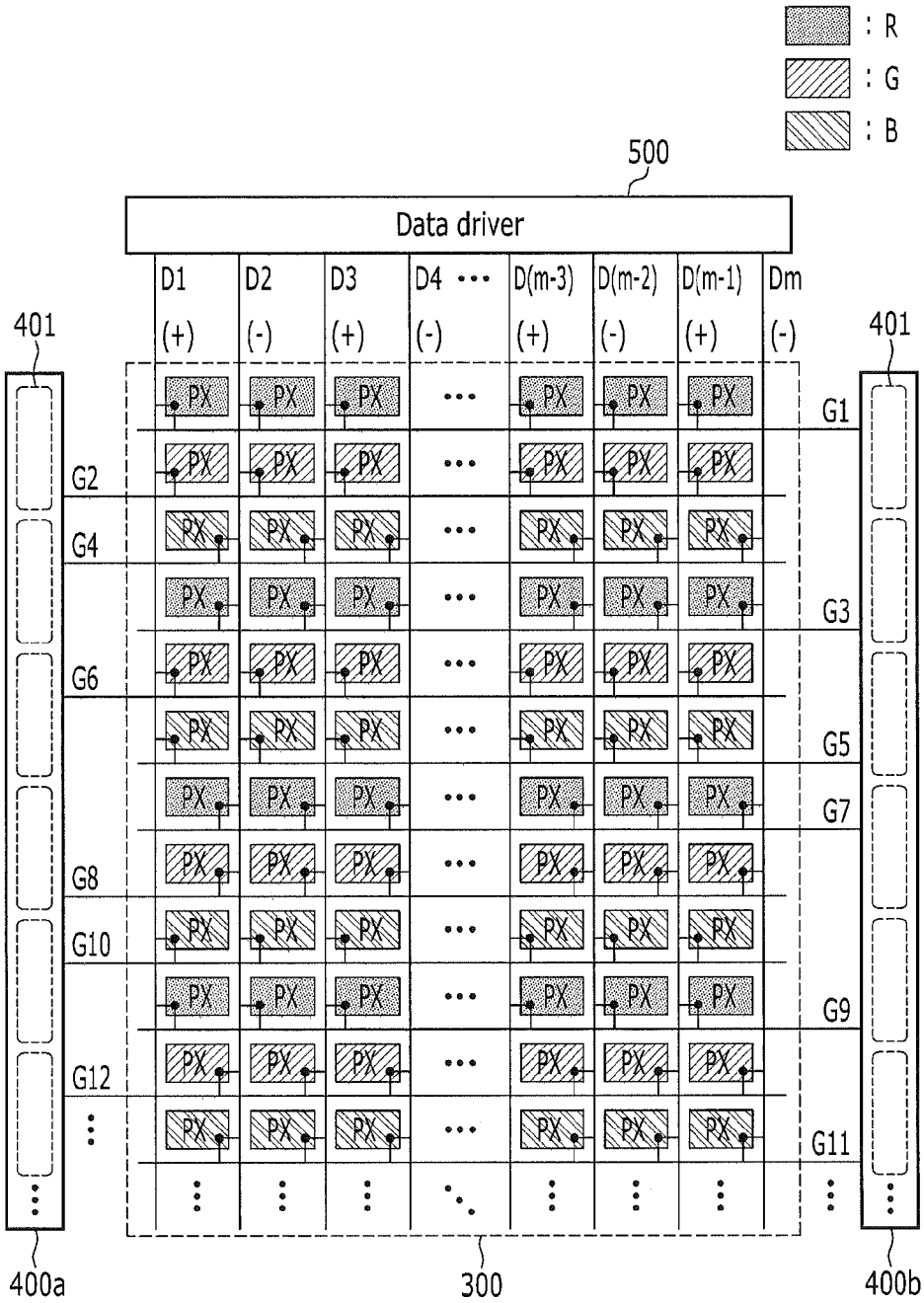
FIG. 1 is a diagram illustrating an exemplary embodiment of a plan view of a pixel and a display signal line of a display device according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, exemplary embodiments of the invention will be described in further detail with reference to the accompanying drawings.

First, a display device according to an exemplary embodiment of the invention will be described with reference to FIGS. 1 and 2.

Figure 2:
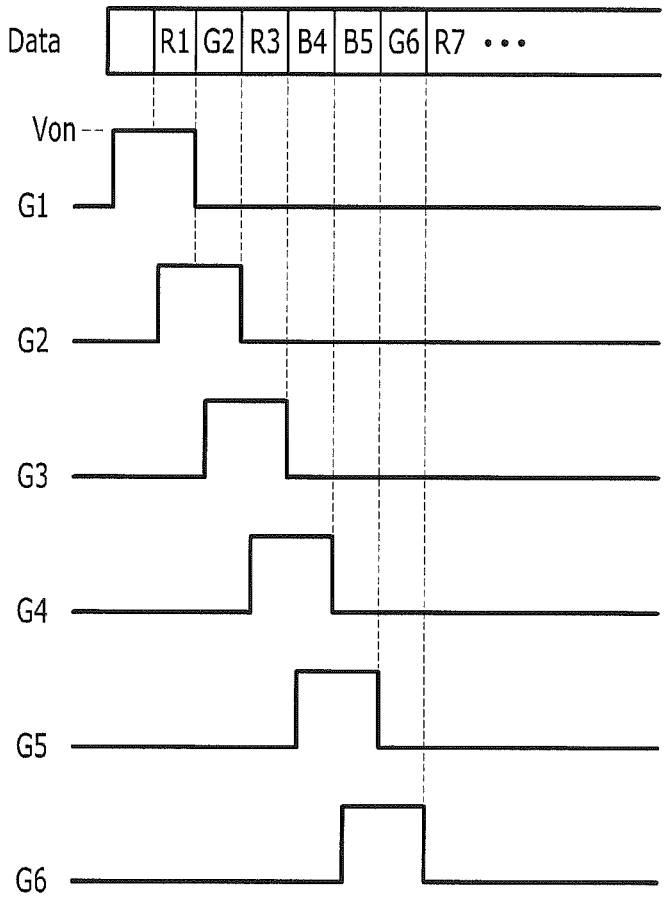
FIG. 2 is a waveform diagram illustrating an exemplary embodiment of an output order of a gate signal and a data voltage of the display device shown in FIG. 1 according to the invention.

FIG. 1 is a diagram illustrating an exemplary embodiment of a plan view of a pixel and a display signal line of a display device according to the invention and FIG. 2 is a waveform diagram illustrating an exemplary embodiment of an output order of a gate signal and a data voltage of the display device shown in FIG. 1 according to the invention.

Referring to FIG. 1, the display device according to an exemplary embodiment of the invention includes a display panel 300, a first gate driver 400*a*, a second gate driver 400*b*, and a data driver 500.

The display panel 300 includes a plurality of pixels PX connected with a plurality of signal lines and arranged in a substantially matrix form.

The signal line includes a plurality of gate lines G1, G2, and the like transmitting a gate signal (also, referred to as a scanning signal) and a plurality of data lines D1 to Dm transmitting a data voltage. The gate lines G1, G2, and the like extend in a substantially row direction and are parallel to each other and the data lines D1 to Dm extend in a substantially column direction and are substantially parallel to each other.

Each pixel PX includes a switching element Q (not shown), which is connected with the gate lines G1, G2, and the like and the data lines D1 to Dm, and a pixel electrode (not shown) receiving the data voltage through the switching element Q.

In order to implement a color display, the each pixel PX may display one of primary colors such that a desired color is displayed by a spatial sum of the primary colors represented by the plurality of the pixels PX. An example of the primary colors may be red R, green G, and blue B, for example, but not limited thereto. In the following description of exemplary embodiments of the invention, the primary colors include red R, green G, and blue B for illustrative purposes; however, it should be noted that the invention is not limited thereto.

Referring to FIG. 1, the pixels PX disposed at the same row may display the same color. For example, when color filters (not shown) for displaying red, green, and blue colors are used in order to implement the color display, the color filters of pixels PX adjacent in a row direction display the same color and are connected to each other to be elongated in a row direction. In an exemplary embodiment, pixels PX adjacent in a column direction may display different colors. For example, when a pixel PX displaying the red R is referred to as a red pixel R, a pixel PX displaying the green G is referred to as a green pixel G, and a pixel PX displaying the blue B is referred to as a blue pixel B, a row of the red pixels R, a row of the green pixels G, and a row of the blue pixels B may be alternately disposed in sequence along the column direction.

Three pixels PX comprising the red pixel R, the green pixel G, and the blue pixel B may form a dot which is a basic unit of an image display.

The switching element Q may be a three-terminal element such as a thin film transistor, for example, but is not limited thereto. A control terminal of the switching element Q may be connected to the gate lines G1, G2, and the like, an input terminal thereof may be connected to the data lines D1 to Dm, and an output terminal thereof may be connected with a pixel electrode (not shown) of a corresponding pixel PX. Referring to FIG. 1, each pixel column is adjacent to two data lines. A plurality of the switching elements Q disposed at one pixel column may be alternately connected, two by two, to the two data lines in the column direction. Also, the switching elements Q disposed at one pixel row may be connected to the data lines D1 to Dm disposed in the same direction relative to the switching elements Q.

The first gate driver 400*a* and the second gate driver 400*b* are positioned at both edge regions of the display panel 300 facing each other with the plurality of pixels PX being interposed therebetween. For example, the first gate driver 400*a* and the second gate driver 400*b* may be disposed at left and right sides of the display panel 300, respectively.

The first gate driver 400*a* and the second gate driver 400*b* each include a plurality of gate driving circuits 401 connected to one another in series and transmitting a gate-on voltage Von to the gate lines G1, G2, and the like in sequence. In the exemplary embodiment shown in FIG. 1, the gate driving circuits 401 of the first gate driver 400*a* are connected in sequence to even-numbered gate lines such as a second gate line G2, a fourth gate line G4, a sixth gate line G6, and the like and the gate driving circuits 401 of the second gate driver 400*b* are connected in sequence to odd-numbered gate lines such as a first gate line G1, a third gate line G3, a fifth gate line G5, and the like. The gate driving circuit 401 generates the gate signal including the gate-on voltage Von and a gate-off voltage Voff to be applied to the gate lines G1, G2, and the like connected thereto. In other words, the gate-on voltage Von may be applied to the gate lines G1, G2, and the like in sequence according to a gate line number such as the first gate line G1, the second gate line G2, the third gate line G3, and the like.

The gate driving circuit 401 may be integrated on the display panel 300 together with the signal line and the switching element Q.

Whether the gate lines G1, G2, and the like are connected to the gate driver 400*a* or the gate driver 400*b* may be determined according to the primary color displayed by the pixel row connected to the corresponding gate line. In other words, the gate line connected with the pixel row displaying the primary color such as red, green, or blue may be connected with one of the gate drivers 400*a* and 400*b* depending on the primary color the pixel row connected with the corresponding gate line displays.

For example, as shown in FIG. 1, all the gate lines G1, G3, G7, G9, and the like connected with the switching element Q of the red pixel R row may be connected with the second gate driver 400*b* and all the gate lines G2, G6, G8, G12, and the like connected with the switching element Q of the green pixel G row may be connected with the first gate driver 400*a*. In addition, the gate lines G4, G5, G10, G11, and the like connected with the switching element Q of the blue pixel B row may be alternately connected to the first gate driver 400*a* and the second gate driver 400*b*.

Accordingly, the gate lines G1, G3, G5, and the like which are connected with the pixels PX of a k-th row (k=6j+1, j=0 or a positive integer), a (k+3)-th row, and a (k+5)-th row may be connected to the second gate driver 400*b* and the gate lines G2, G4, G6, and the like which are connected with the pixels PX of a (k+1)-th row, a (k+2)-th row, and a (k+4)-th row may be connected to the first gate driver 400*a*.

As such, when the two gate drivers 400*a* and 400*b* are disposed on both sides of the display panel 300, a sufficient space for integrating the gate driving circuit 401 including the gate driver 400*a* or 400*b* may be ensured, particularly in the column direction. Referring to FIG. 1, the space for integrating the gate driving circuit 401 is provided, wherein the space has a width corresponding to a width of two pixel rows in the column direction. Accordingly, when the gate driving circuit 401 is integrated, various circuit defects generated due to a smaller integration space can be reduced.

The data driver 500 is connected to the data lines D1 to Dm of the display panel 300. The data driver 500, which is implemented in an integrated ("IC") chip form, may be directly mounted on the display panel 300, mounted on a flexible printed circuit film (not shown) to be attached to the display panel 300 as a tape carrier package (TCP), mounted on a separate printed circuit board (PCB) (not shown), or integrated into the display panel 300 together with the gate drivers 400*a* and 400*b*.

Since a horizontal length of the pixel PX according to the exemplary embodiment of the invention is longer than a vertical length thereof, the number of the pixels PX disposed in each pixel row may be reduced, as compared with a case where the horizontal length of the pixel PX is smaller than the vertical length thereof. Accordingly, since the entire number of the data lines D1 to Dm may be reduced, the number of the IC chips of the data driver 500 may be reduced, thereby reducing a manufacturing cost.

Hereinafter, an operation of the display device shown in FIG. 1 will be described with reference to FIGS. 1 and 2.

The gate driving circuits 401 of the second gate driver 400*b* apply the gate-on voltage Von to the gate lines G1, G3, G5, and the like in sequence and the gate driving circuits 401 of the first gate driver 400*a* apply the gate-on voltage Von to the gate lines G2, G4, G6, and the like. Here, the second gate driver 400*b* and the first gate driver 400*a* apply the gate-on voltage Von in turn. Accordingly, as shown in FIG. 2, the gate-on voltage Von is sequentially applied to the gate lines G1, G2, G3, and the like in sequence. Therefore, as shown in FIG. 2, with respect to the pixels PX of the k-th row (k=6j+1, j=0 or a positive integer) to the (k+5)-th row, the gate-on voltage Von is applied in an order of the k-th row of the red pixel R, the (k+1)-th row of the green pixel G, the (k+3)-th row of the red pixel R, the (k+2)-th row of the blue pixel B, the (k+5)-th row of the blue pixel B and the (k+4)-th row of the green pixel G, to turn on the switching element Q of the corresponding pixel.

The data driver 500 applies the data voltage corresponding to a gray scale of a displayed image to the data lines D1 to Dm. An output order of the data voltage outputted from the data driver 500 corresponds with an order in which the gate-on voltage Von is applied to the gate lines G1, G2, and the like connected with the corresponding switching element Q. For example, when the data voltage applied to the red pixel R, the green pixel G, or the blue pixel B connected to a gate line Gn (n is a natural number) is represented by 'Rn,' 'Gn,' or 'Bn,' respectively, the data voltage is outputted in an order of Rk, G(k+1), R(k+2), B(k+3), B(k+4), and G(k+5) (k=6j+1, j=0 or a positive integer).

The data voltage is charged in the pixel electrode of the corresponding pixel PX through the turned-on switching element Q. In a liquid crystal display, a difference between the data voltage applied to the pixel PX and a common voltage Vcom is represented as a charge voltage of a liquid crystal capacitor.

The gate signals transmitted to the gate lines G1, G2, and the like from the gate driving circuits 401 of the gate drivers 400*a* and 400*b* are delayed by the gate lines G1, G2, and the like. Accordingly, the data voltage may not be sufficiently applied to the pixel electrode of the pixel PX disposed in a distance away from the gate driving circuit 401 or the data voltage for another pixel PX may be applied thereto, such that a difference in charging rate of the pixels PX may occur among the gate lines G1, G2, and the like. Therefore, even when the pixels PX of one pixel row displaying the same color have the same gray scale, luminance in the pixels PX may be deteriorated in the pixel located farther away from the gate driving circuit 401.

As shown in the exemplary embodiment of the invention, when the gate lines, which are connected with the pixel row of a first color (e.g., the red in FIG. 1), are connected to the second gate driver 400*b* and the gate lines, which are connected with the pixel row of a second color (e.g., the green in FIG. 1), are connected to the first gate driver 400*a*, charging rates of the pixels PX, displaying the same color and disposed at the same column, are substantially the same with one another. Accordingly, the display defect such as a horizontal line which can be shown when the gate lines G1, G2, and the like are alternately connected to two the gate drivers 400*a* and 400*b* regardless of the colors displayed by the pixels PX may not occur. In the exemplary embodiment, the gate lines connected with the pixels PX of a third color (e.g., the blue in FIG. 1) are alternately connected to the two gate drivers 400*a* and 400*b;* however, the number of the third color pixels PX corresponds to one third of the entire pixels PX, such that the display defect such as the horizontal line may be reduced as compared to the prior art. In particular, as shown in FIGS. 1 and 2, when the third color is blue B, of which visibility is low relative to the green and the red (for example, less than 10%), a horizontal line pattern due to the blue pixel B may not be visible.

According to the exemplary embodiment of the invention, each dot comprises the red pixel R, the green pixel G, and the blue pixel B, and thus, a row of dots are connected to three gate lines such that it may be difficult to apply the gate-on voltage Von in a limited time frame. However, as shown in FIG. 2, a time period during which the gate-on voltage Von is applied to the gate lines G1, G2, G3, and the like may be temporally overlapped between adjacent gates, such that the data voltage can be applied during a sufficiently long duration.

The gate-on voltages Von are applied to the gate lines G1, G2, and the like and the data voltages are applied to the pixels PX, such that an image of one frame can be displayed. Subsequently, a next frame is displayed, and a frame inversion is performed by controlling an inversion signal to be applied to the data driver 500 so that a polarity of the data voltage applied to each pixel PX is opposite to a polarity thereof in the previous frame. In this case, according to a characteristic of the inversion signal, the polarity of the data voltage provided through the data lines D1 to Dm may be changed within one frame or the polarities of the data voltages applied to one pixel row may be changed within one frame while being different from each other between adjacent pixels. The polarity of the data voltage may be determined with respect to the common voltage Vcom.

In the exemplary embodiment shown in FIG. 1, the polarities of the data voltages applied to the adjacent data lines D1 to Dm are opposite to each other and the polarity of the data voltage applied to the data lines D1 to Dm may not be changed and be maintained substantially the same during one frame. In this case, the switching elements Q are alternately connected to different data lines D1 to Dm in every two pixel rows, such that the frame inversion may appear as a 2×1 dot inversion.

Next, a display device according to other exemplary embodiments of the invention will be described with reference to FIGS. 3 to 16. Like elements are identified by like reference numerals and an identical description thereof will be omitted.

Figure 3:
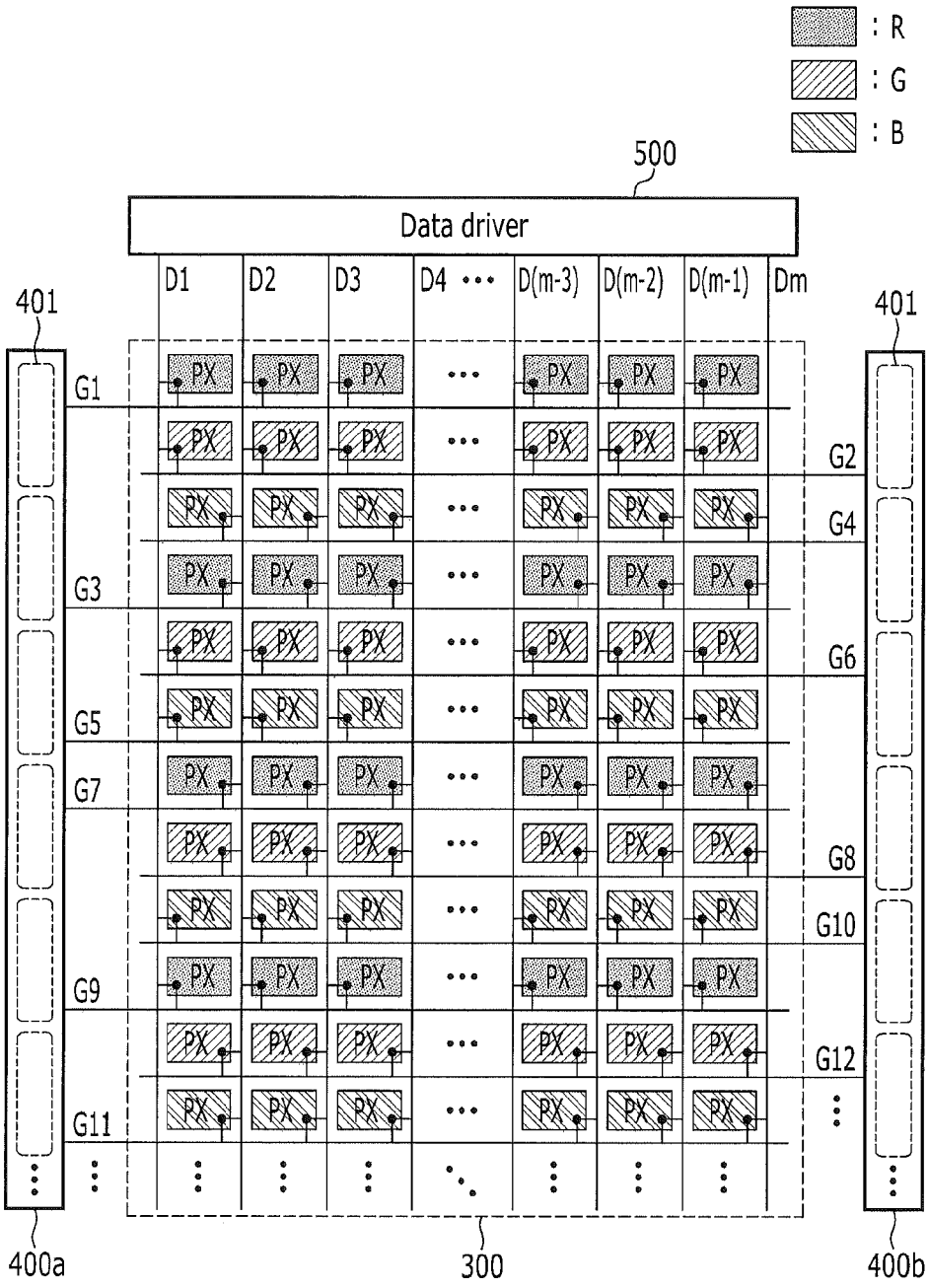
FIGS. 3 and 4 are diagrams illustrating alternative exemplary embodiments of a plan view of a pixel and a display signal line of a display device according to the invention.
Figure 4:
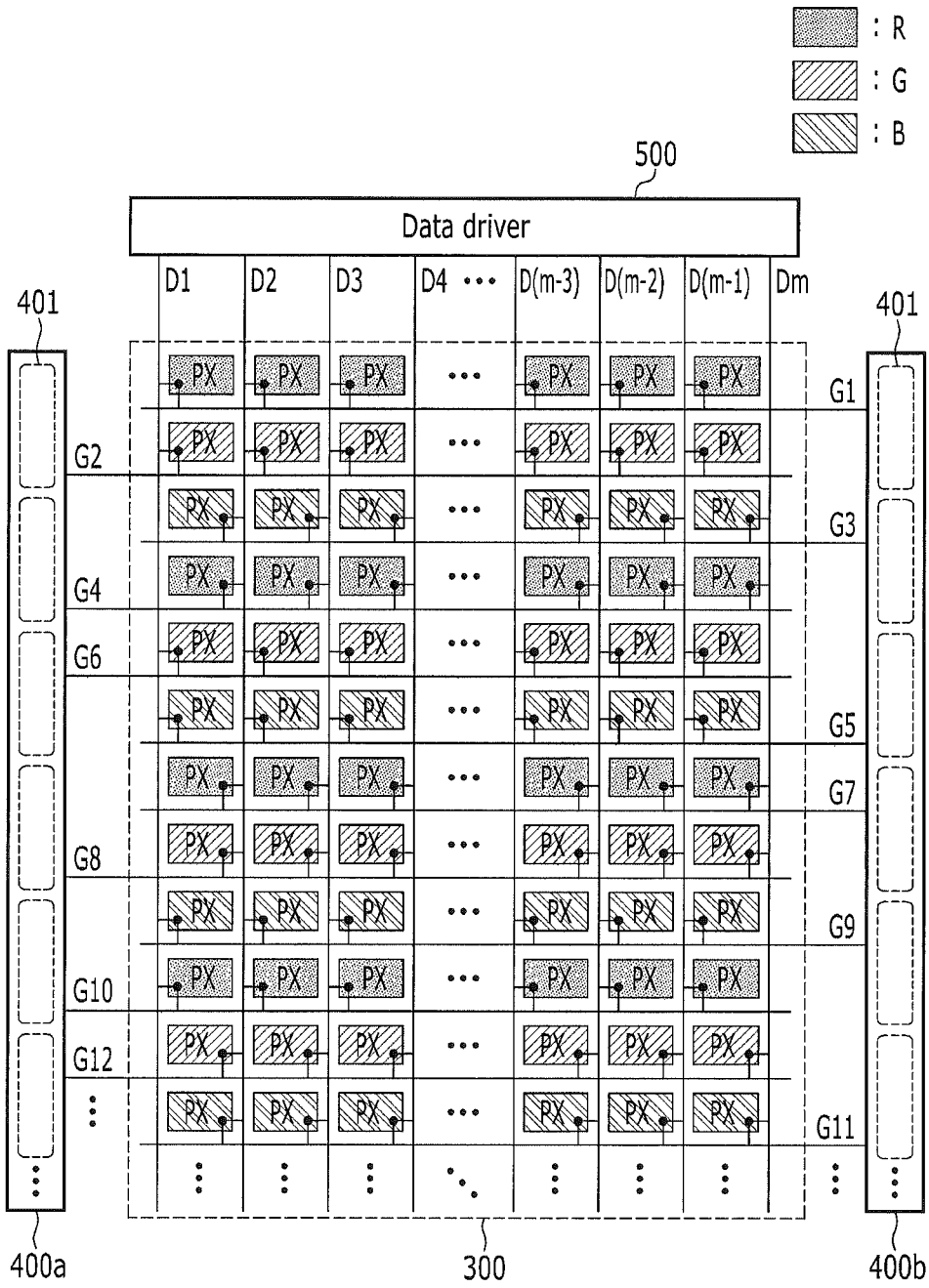
Figure 5:
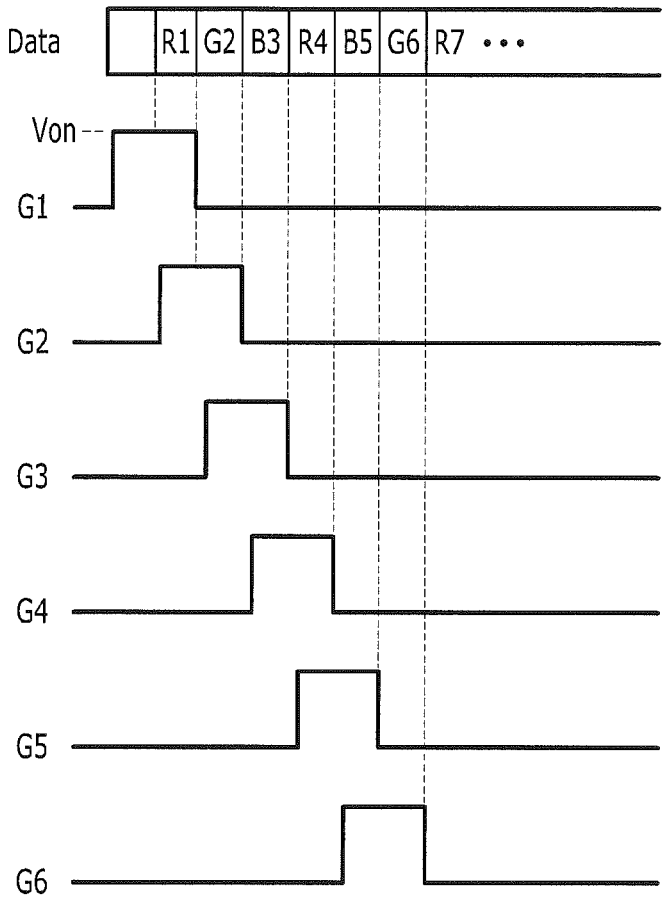
FIG. 5 is a waveform diagram illustrating an exemplary embodiment of an output order of a gate signal and a data voltage of the display device shown in FIG. 4 according to the invention.
Figure 6:
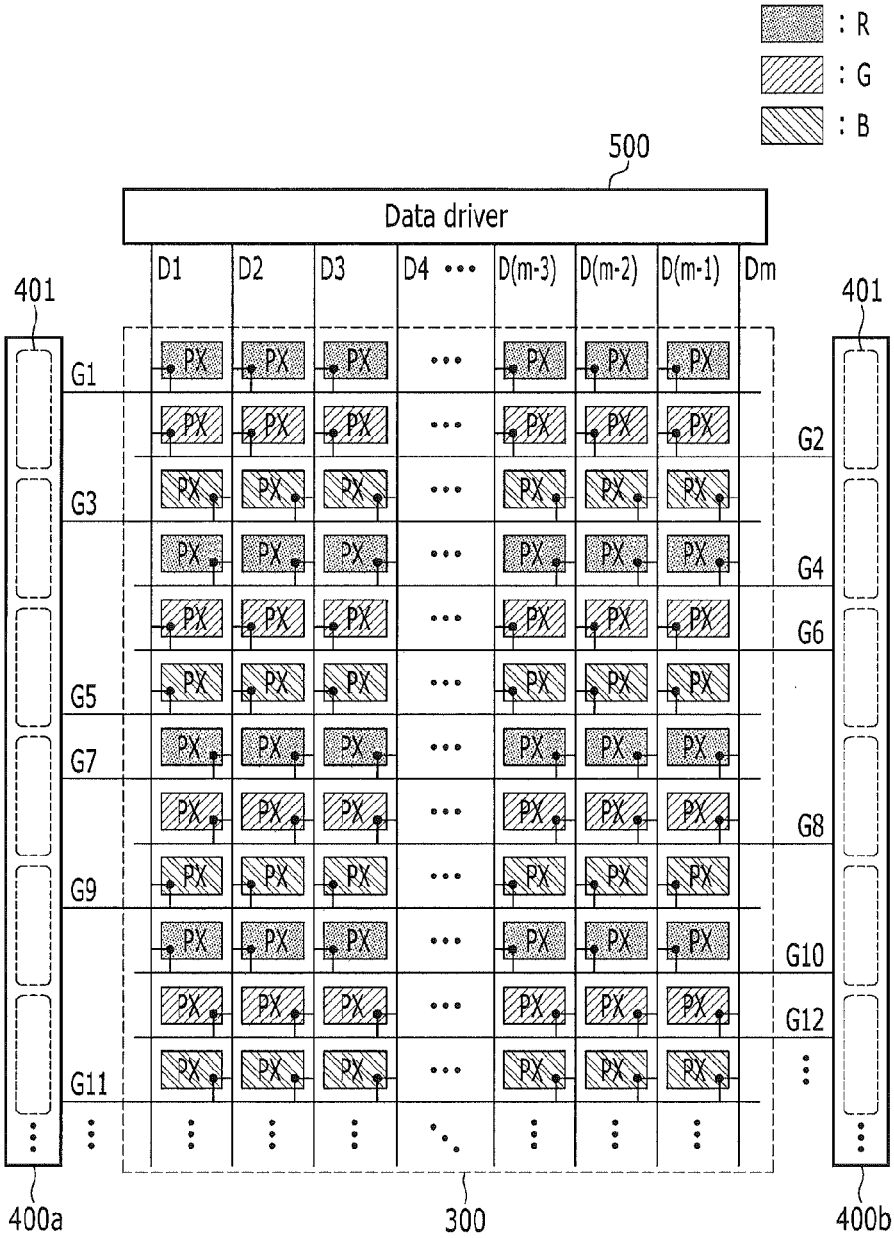
FIGS. 6 and 7 are diagrams illustrating yet alternative exemplary embodiments of a plan view of a pixel and a display signal line of a display device according to the invention.
Figure 7:
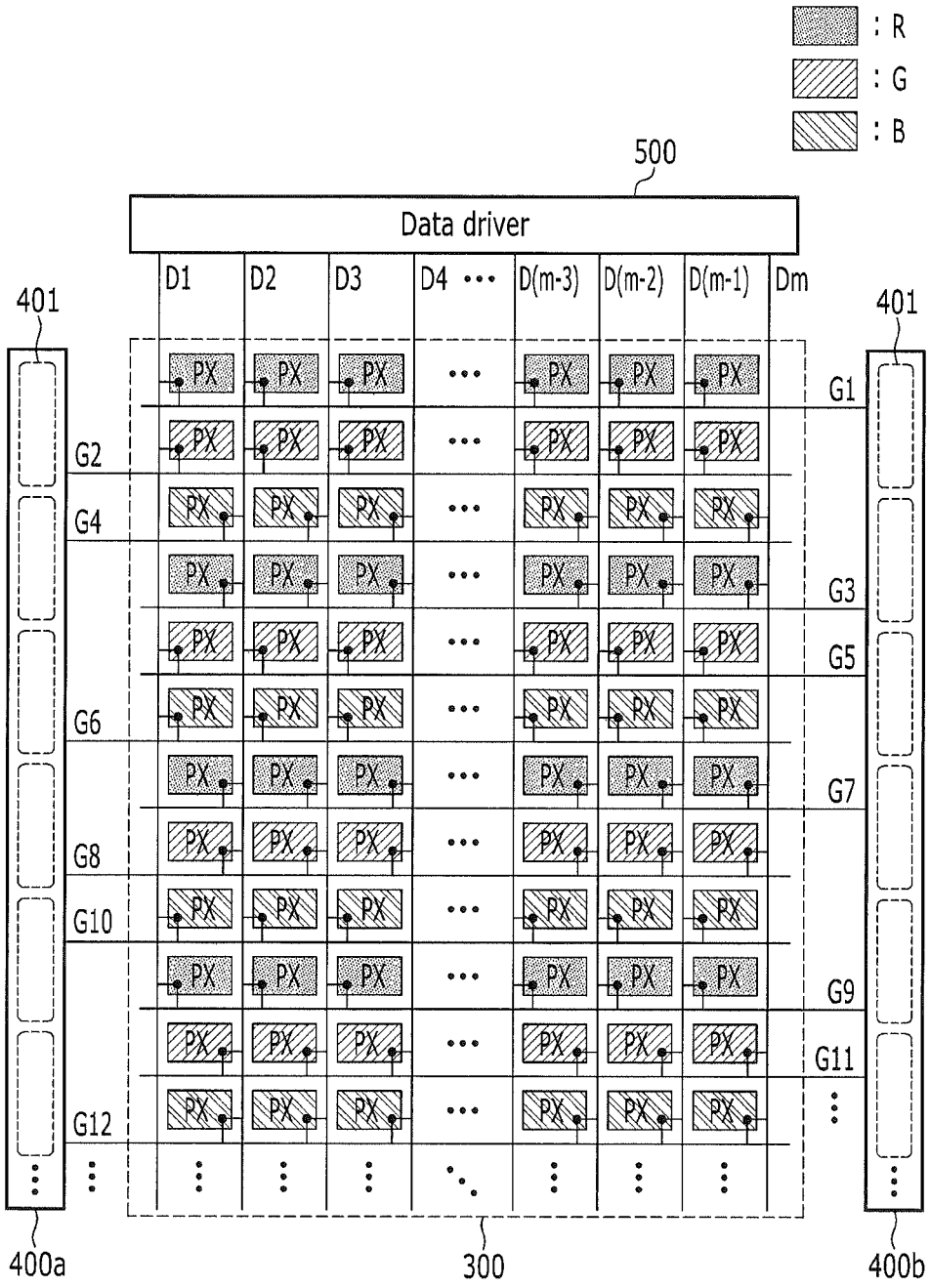
Figure 8:
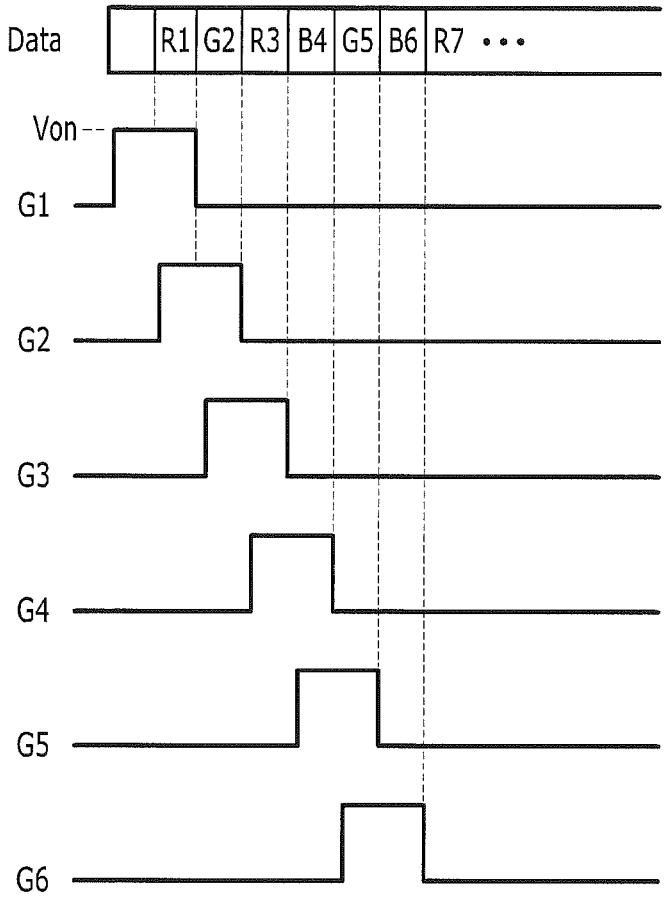
FIG. 8 is a waveform diagram illustrating an exemplary embodiment of an output order of a gate signal and a data voltage of the display device shown in FIG. 7 according to the invention.

FIGS. 3, 4, 6, 7, and 9 to 16 are diagrams illustrating exemplary embodiments of plan view of a pixel and a display signal line of a display device according to the invention, FIG. 5 is a waveform diagram illustrating an exemplary embodiment of an output order of gate signals and data voltages of the display device shown in FIG. 4 according to the invention, and FIG. 8 is a waveform diagram illustrating an exemplary embodiment of an output order of gate signals and data voltages of the display device according to the invention.

The display device according to the exemplary embodiment shown in FIG. 3 is substantially similar to the display device shown in FIG. 1. However, in FIG. 3, the gate lines G1, G2, and the like connected to the first gate driver 400*a* and the second gate driver 400*b* may be changed to each other. That is, the gate lines G1, G3, G7, G9, and the like connected with the switching element Q of the red pixel R row may be connected with the first gate driver 400*a* and the gate lines G2, G6, G8, G12, and the like connected with the switching element Q of the green pixel G row may be connected with the second gate driver 400*b*. In addition, the gate lines G4, G5, G10, G11, and the like connected with the switching element Q of the blue pixel B row may be alternately connected to the second gate driver 400*b* and the first gate driver 400*a*.

Accordingly, the gate lines G1, G3, G5, and the like which are connected with the pixels PX of the k-th row (k=6j+1, j=0 or a positive integer), the (k+3)-th row, and the (k+5)-th row may be connected to the first gate driver 400*a* and the gate lines G2, G4, G6, and the like which are connected with the pixels PX of the (k+1)-th row, the (k+2)-th row, and the (k+4)-th row may be connected to the second gate driver 400*b*.

A driving method and a driving signal of the display device according to the exemplary embodiment of FIG. 3 may be in accordance with the waveform diagram shown in FIG. 2. Thus, the characteristics and the effect of the display device shown in FIGS. 1 and 2 may be equally achieved by the exemplary embodiment shown in FIG. 3.

The display device according to the exemplary embodiment shown in FIG. 4 is substantially similar to the display device shown in FIG. 1 described above. However, unlike the exemplary embodiment shown in FIG. 1, in which the gate lines connected with the red pixel R and the green pixel G are connected to the gate drivers 400*b* and 400*a*, respectively, and the gate lines connected with the blue pixel B row are alternately connected to the two gate drivers 400*a* and 400*b*, in the exemplary embodiment shown in FIG. 4, the gate lines G1, G4, G7, G10, and the like connected with the red pixel R row are alternately connected to the second gate driver 400*b* and the first gate driver 400*a*. In addition, the gate lines G2, G6, G8, G12, and the like connected to the green pixel G row may be connected to the first gate driver 400*a* and the gate lines G3, G5, G9, G11, and the like connected with the blue pixel B column may be connected to the second gate driver 400*b*.

Accordingly, the gate lines G1, G3, G5, and the like which are connected with the pixels PX of the k-th row (k=6j+1, j=0 or a positive integer), the (k+2)-th row, and the (k+5)-th row may be connected to the second gate driver 400*b* and the gate lines G2, G4, G6, and the like which are connected with the pixels PX of the (k+1)-th row, the (k+3)-th row, and the (k+4)-th row may be connected to the first gate driver 400*a*.

Since an operation of the display device shown in FIG. 4 is substantially similar to the operation of the display device shown in FIGS. 1 and 2 described above, an identical description thereof is omitted. However, referring to FIGS. 4 and 5, with respect to the pixels PX from the k-th row (k=6j+1, j=0 or a positive integer) to the (k+5)-th row, the gate-on voltage Von is applied in an order of the k-th row of the red pixel R, the (k+1)-th row of the green pixel G, the (k+2)-th row of the blue pixel B, the (k+3)-th row of the red pixel R, the (k+5)-th row of the blue pixel B and the (k+4)-th row of the green pixel G, to turn on the switching element Q of the corresponding pixel. Accordingly, the data voltages of the data lines D1 to Dm are outputted in an order of Rk, G(k+1), B(k+2), R(k+3), B(k+4), and G(k+5) (k=6j+1, j=0 or a positive integer).

According to the exemplary embodiment shown in FIG. 4, when the gate lines connected with the green pixel G are connected to the first gate driver 400*a* and the gate lines connected with the blue pixel B are connected to the second gate driver 400*b*, the charging rates of the pixels PX, displaying the same color and disposed at the same column, are substantially the same with one another. Thus, the display defect such as a visible horizontal line can be improved. Also, the red pixel R of which gate lines are alternately connected to the two gate drivers 400*a* and 400*b* has a lower visibility, such that the horizontal line defect due to the delay of the gate signal may not be visible.

The characteristics and the effect of the display device shown in FIGS. 1 and 2 may be equally achieved by the exemplary embodiment shown in FIGS. 4 and 5.

The display device according to the exemplary embodiment shown in FIG. 6 is substantially similar to the display device shown in FIG. 4 described above. However, the gate lines G1, G2, and the like connected to the first gate driver 400*a* and the second gate driver 400*b* may be changed to each other. That is, the gate lines G2, G6, G8, G12, and the like connected with the switching element Q of the green pixel G row may be connected with the second gate driver 400*b* and the gate lines G3, G5, G9, G11, and the like connected with the switching element Q of the blue pixel B row may be connected with the first gate driver 400*a*. In addition, the gate lines G1, G4, G7, G10, and the like connected with the switching element Q of the red pixel R row may be alternately connected to the first gate driver 400*a* and the second gate driver 400*b*.

Accordingly, the gate lines G1, G3, G5, and the like which are connected with the pixels PX of the k-th row (k=6j+1, j=0 or a positive integer), the (k+2)-th row, and the (k+5)-th row may be connected to the first gate driver 400*a* and the gate lines G2, G4, G6, and the like which are connected with the pixels PX of the (k+1)-th row, the (k+3)-th row, and the (k+4)-th row may be connected to the second gate driver 400*b*.

A driving method and a driving signal of the display device according to the exemplary embodiment of FIG. 6 may be in accordance with the waveform diagram shown in FIG. 5. In addition, the characteristics and the effect of the display device shown in FIGS. 1 and 2 may be equally achieved by the exemplary embodiment shown in FIG. 6.

The display device according to the exemplary embodiment shown in FIG. 7 is substantially similar to the display device shown in FIG. 1 described above. However, unlike the exemplary embodiment shown in FIG. 1 in which the gate lines connected with the red pixel R row and the green pixel G row are connected to the gate drivers 400*b* and 400*a*, respectively, and the gate lines connected with the blue pixel B row are alternately connected to the gate drivers 400*a* and 400*b*, in the exemplary embodiment shown in FIG. 7, the gate lines G2, G5, G8, G11, and the like connected with the green pixel G row are alternately connected to the first gate driver 400*a* and the second gate driver 400*b*. In addition, the gate lines G1, G3, G7, G9, and the like connected to the red pixel R row may be connected with the second gate driver 400*b* and the gate lines G4, G6, G10, G12, and the like connected with the blue pixel B row may be connected with the first gate driver 400*a*.

Accordingly, the gate lines G1, G3, G5, and the like which are connected with the pixels PX of the k-th row (k=6j+1, j=0 or a positive integer), the (k+3)-th row, and the (k+4)-th row may be connected to the second gate driver 400*b* and the gate lines G2, G4, G6, and the like which are connected with the pixels PX of the (k+1)-th row, the (k+2)-th row, and the (k+5)-th row may be connected to the first gate driver 400*a*.

Since an operation of the display device shown in FIG. 7 is substantially similar to the operation of the display device shown in FIGS. 1 and 2 described above, an identical description thereof is omitted. However, referring to FIGS. 7 and 8, with respect to the pixels PX from the k-th row (k=6j+1, j=0 or a positive integer) to the (k+5)-th row, the gate-on voltage Von is applied in an order of the k-th row of the red pixel R, the (k+1)-th row of the green pixel G, the (k+3)-th row of the red pixel R, the (k+2)-th row of the blue pixel B, the (k+4)-th row of the green pixel G and the (k+5)-th row of the blue pixel B, to turn on the switching element Q of the corresponding pixel. Accordingly, the data voltages of the data lines D1 to Dm are outputted in an order of Rk, G(k+1), R(k+2), B(k+3), G(k+4), and B(k+5) (k=6j+1, j=0 or a positive integer).

The characteristics and the effect of the display device shown in FIGS. 1 and 2 may be equally achieved by the exemplary embodiment shown in FIG. 7. In the exemplary embodiment, the gate lines connected with the green pixel G row having a relatively high visibility are alternately connected to the two gate drivers 400*a* and 400*b*; however, the number of the green pixels G correspond to one third of the number of the entire pixels PX, such that the horizontal line due to the delay of the gate signal corresponding to the green pixel G may not be visible.

Figure 9:
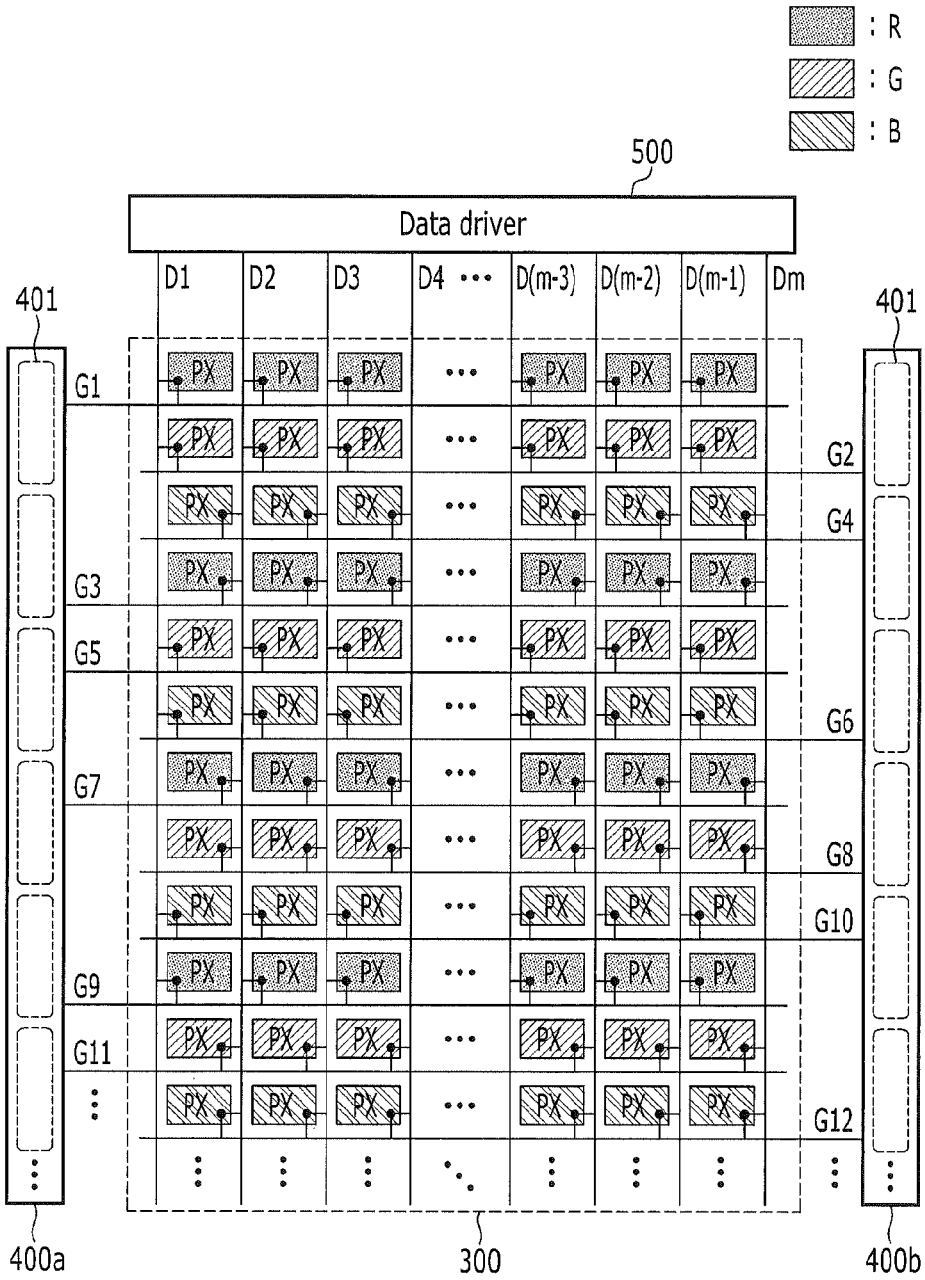
FIGS. 9 to 16 are diagrams illustrating yet alternative exemplary embodiments of a plan view of a pixel and a display signal line of a display device according to the invention.
Figure 10:
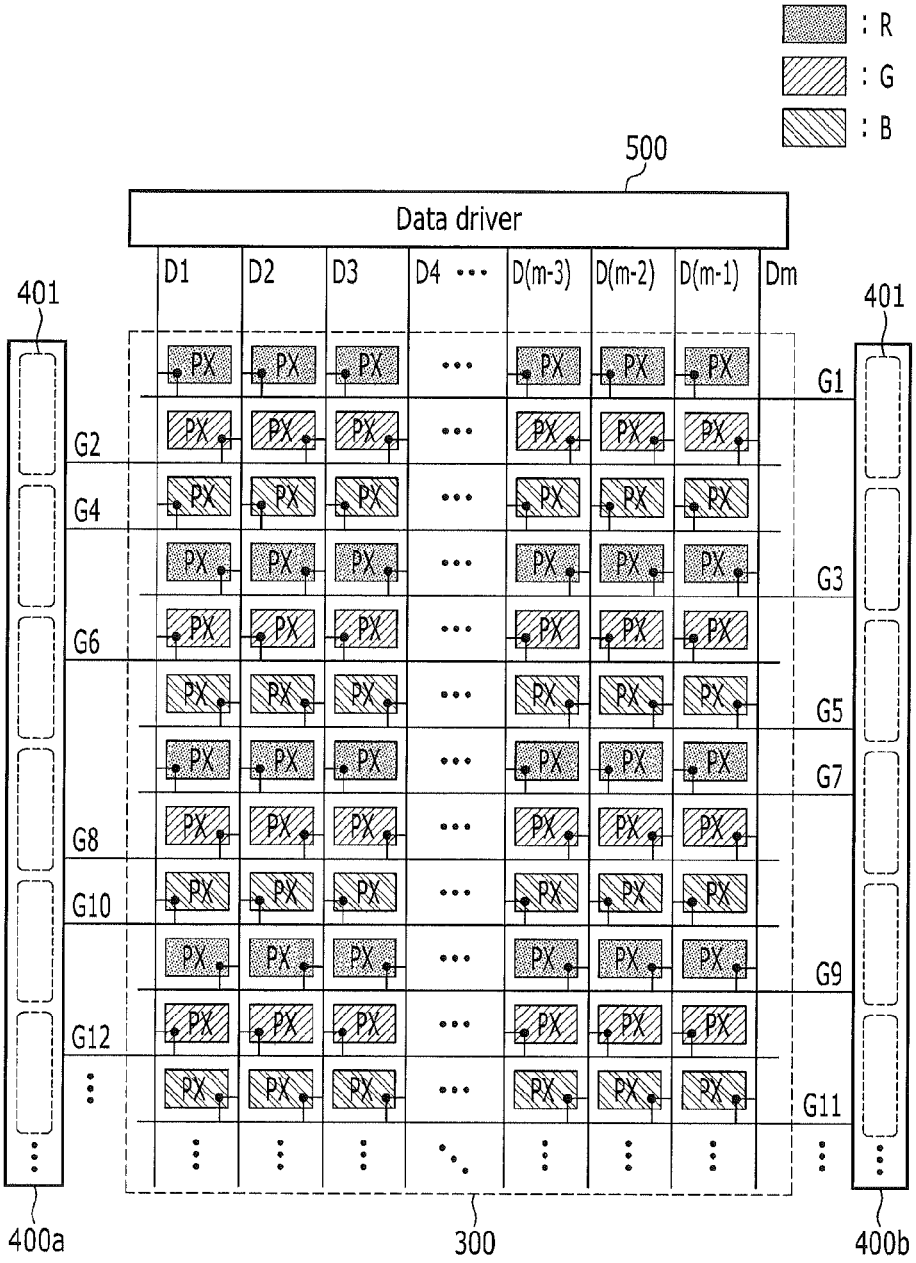
Figure 11:
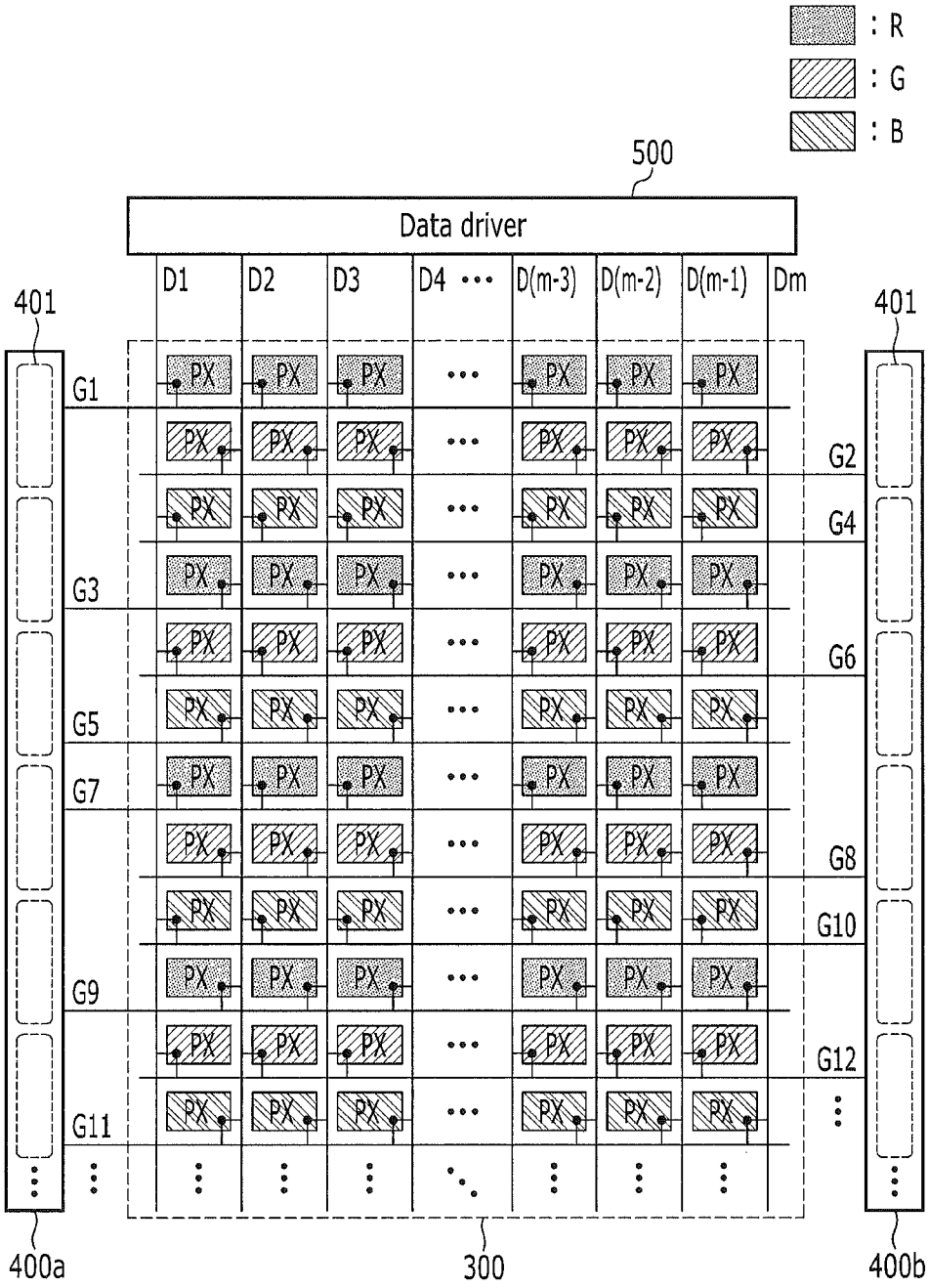
Figure 12:
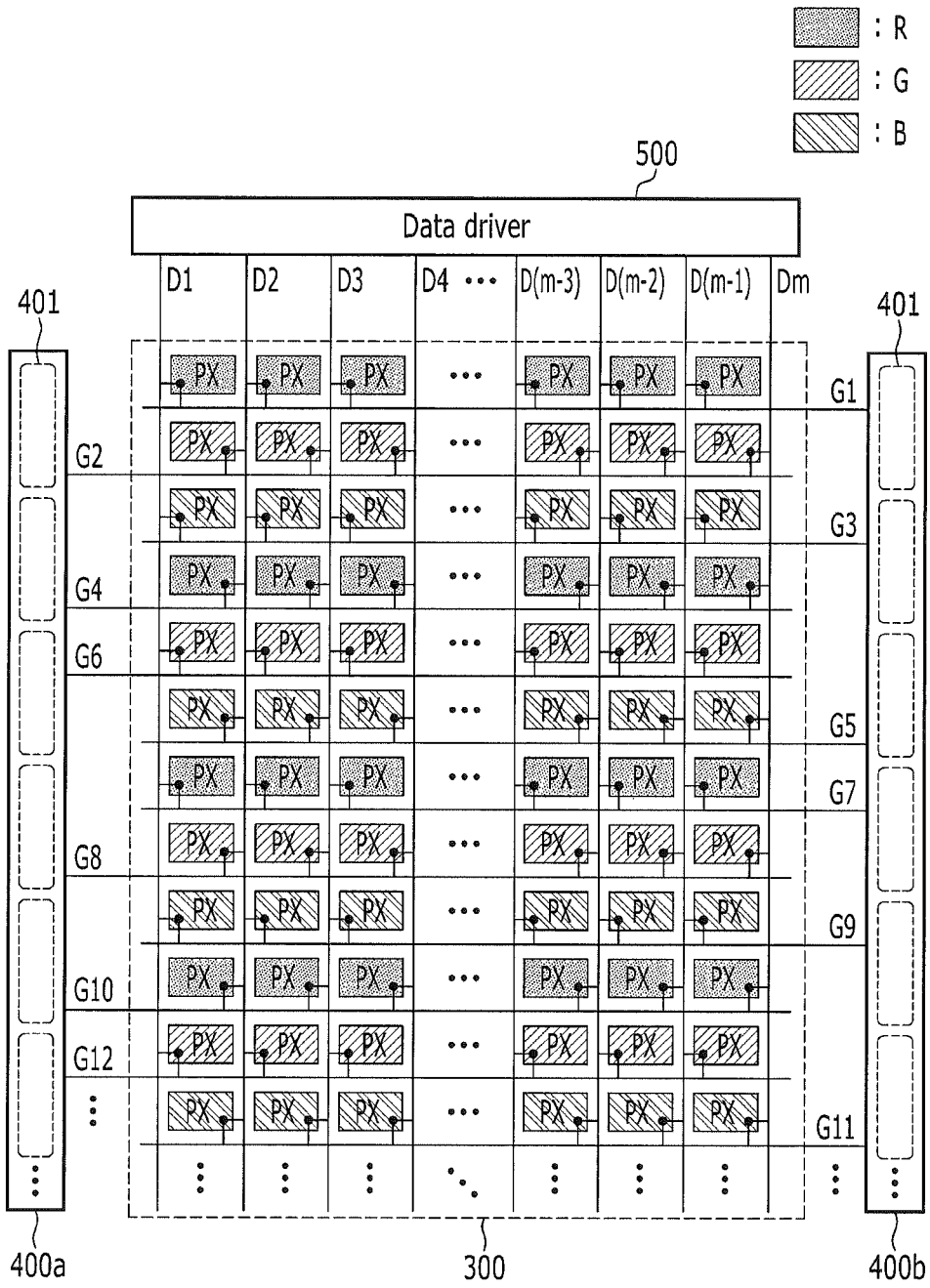
Figure 13:
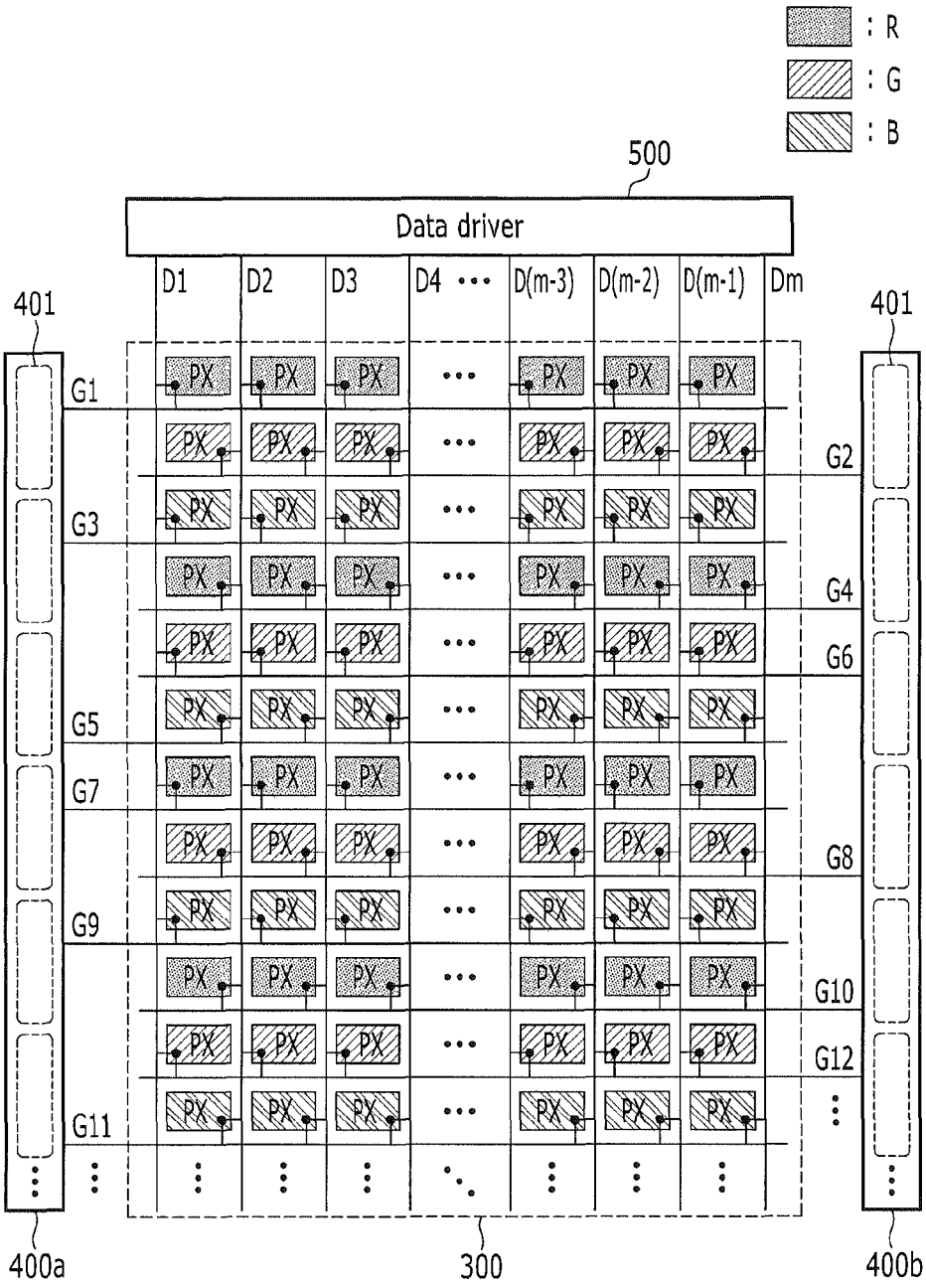
Figure 14:
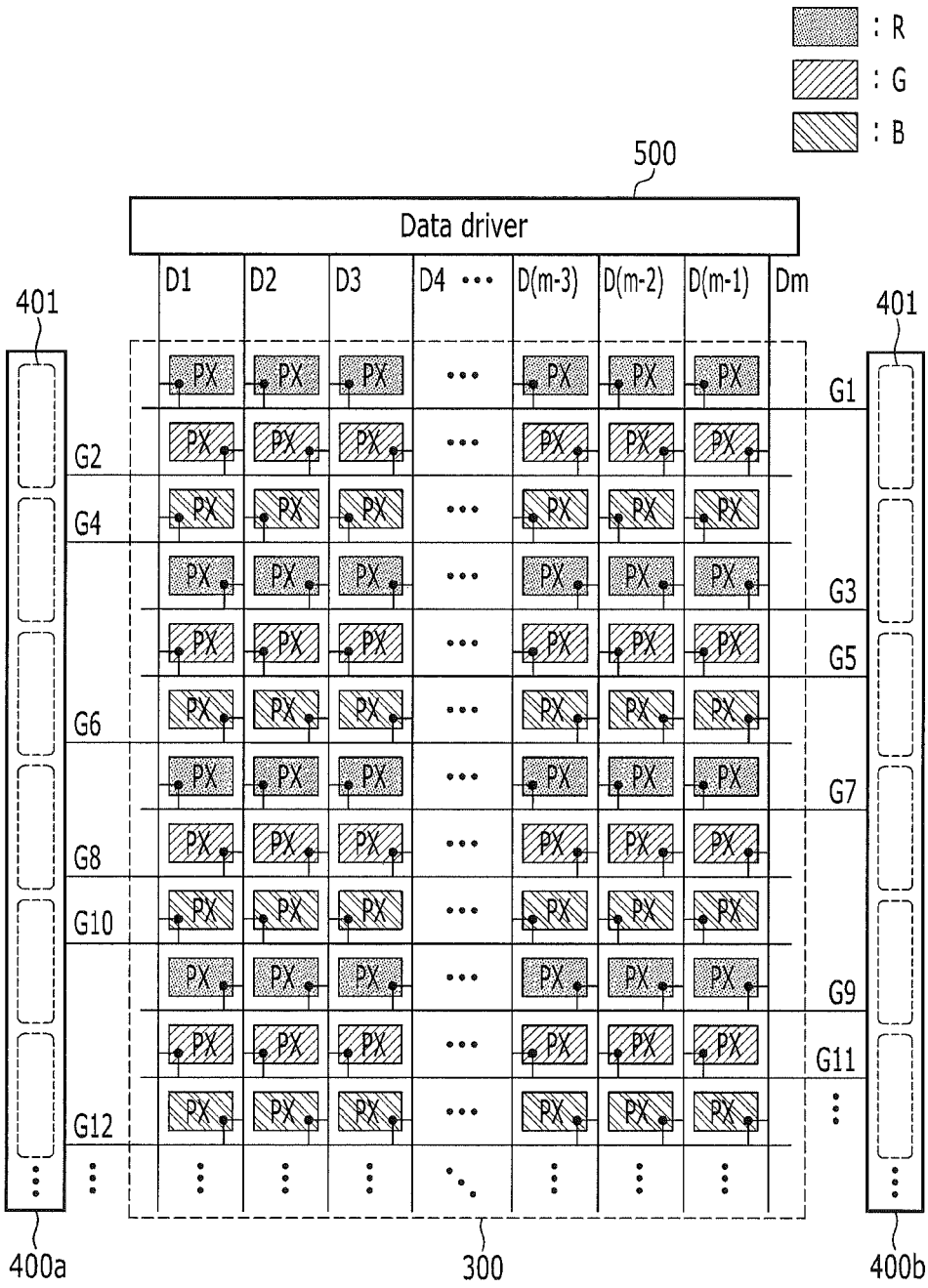
Figure 15:
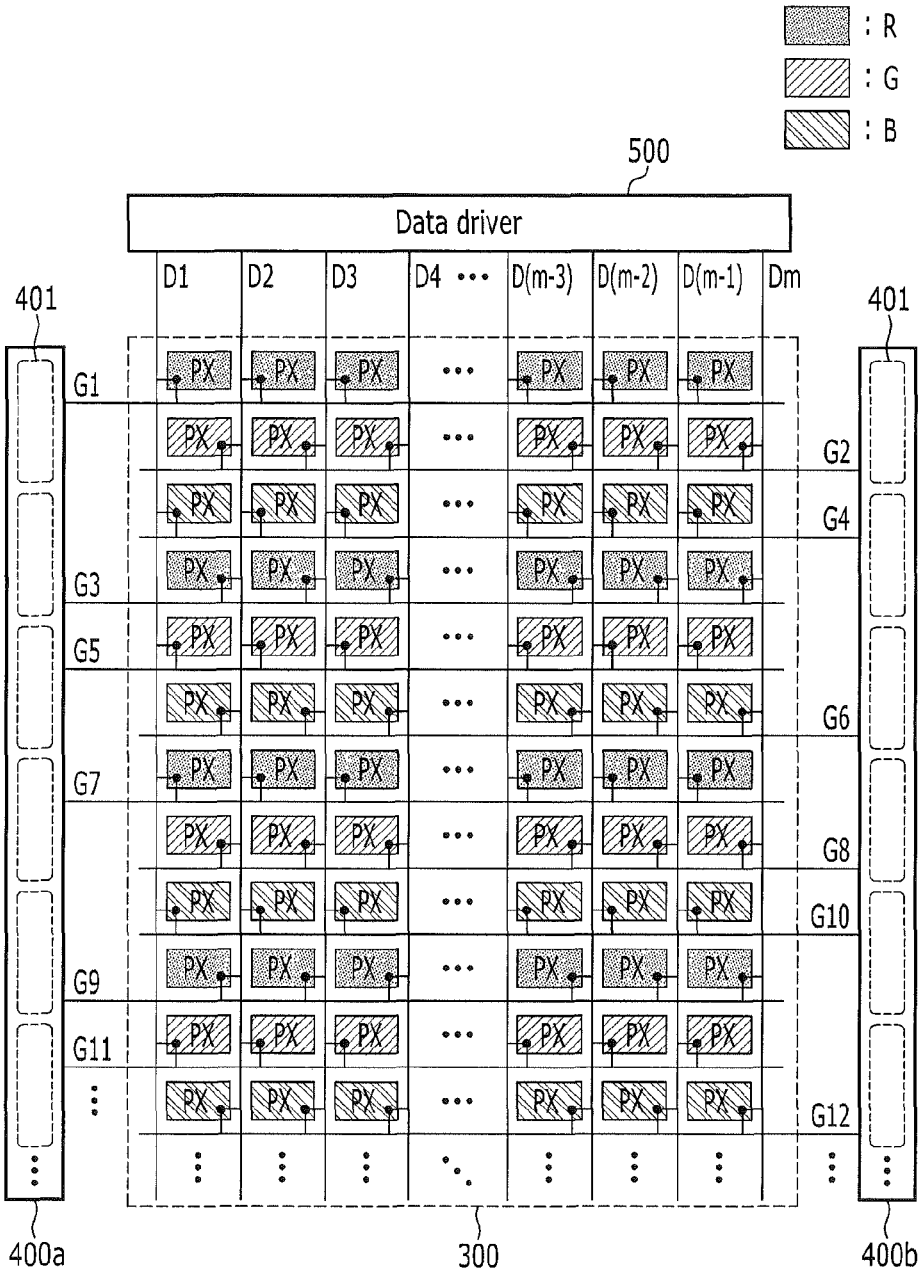

The display device according to the exemplary embodiment shown in FIG. 9 is substantially similar to the display device shown in FIG. 7 described above. However, the gate lines G1, G2, and the like connected to the first gate driver 400*a* and the second gate driver 400*b* may be changed to each other. That is, the gate lines G1, G3, G7, G9, and the like connected with the switching element Q of the red pixel R row may be connected with the first gate driver 400*a* and the gate lines G4, G6, G10, G12, and the like connected with the switching element Q of the blue pixel B row may be connected with the second gate driver 400*b*. In addition, the gate lines G2, G5, G8, G11, and the like connected with the switching element Q of the green pixel G row may be alternately connected to the second gate driver 400*b* and the first gate driver 400*a*.

Accordingly, the gate lines G1, G3, G5, and the like which are connected with the pixels PX of the k-th row (k=6j+1, j=0 or a positive integer), the (k+3)-th row, and the (k+4)-th row may be connected to the first gate driver 400*a* and the gate lines G2, G4, G6, and the like which are connected with the pixels PX of the (k+1)-th row, the (k+2)-th row, and the (k+5)-th row may be connected to the second gate driver 400*b*.

A driving method and a driving signal of the display device according to the exemplary embodiment of FIG. 9 may be in accordance with the waveform diagram shown in FIG. 8. In addition, the characteristics and the effect of the display device shown in FIGS. 1 and 2 may be equally achieved by the exemplary embodiment shown in FIG. 9.

The display device according to exemplary embodiments shown in FIGS. 10, 11, 12, 13, 14, and 15 are substantially similar to the display device shown in FIGS. 1, 3, 4, 6, 7, and 9 described above, respectively. However, unlike the exemplary embodiments described above, the switching elements Q disposed in the pixel column are alternately connected to two data lines. According to the exemplary embodiments, the polarities of the data voltages of the adjacent data lines D1 to Dm are opposite to each other, such that the frame inversion may appear as a 1×1 dot inversion.

Figure 16:
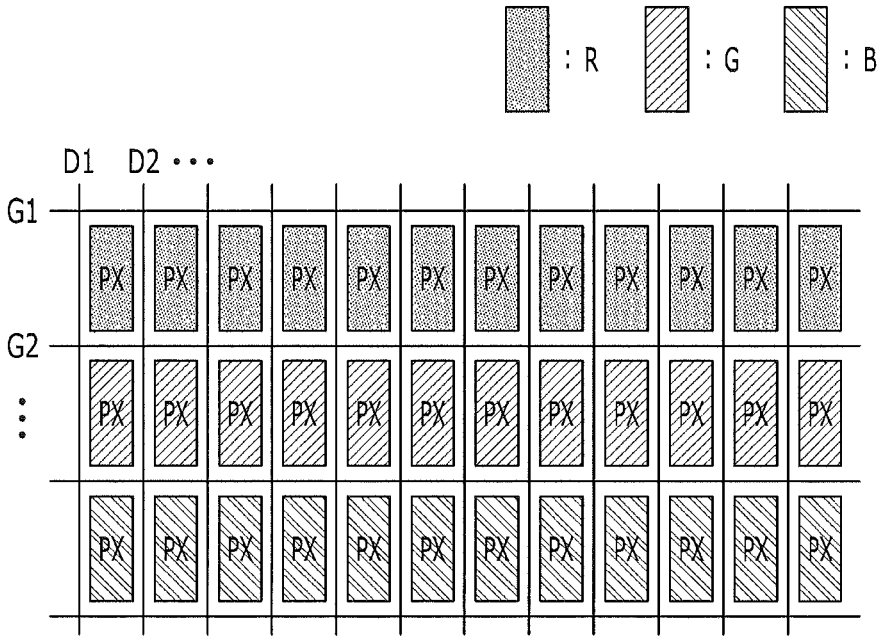

In the exemplary embodiments described above, a row direction length of the pixel PX is longer than a column direction length thereof, except for the exemplary embodiment shown in FIG. 16, in which the column direction length of the pixel PX is longer than the row direction length thereof For example, in the exemplary embodiment of FIG. 16, the column direction length of the pixel PX may be about three times longer than the row direction length thereof According to the exemplary embodiment shown in FIG. 16, although the number of the IC chips of the data driver 500 may not be reduced, other characteristics and the effect of the exemplary embodiments described above may be equally achieved.

Further, in the exemplary embodiments described above, one data line is disposed per one pixel column, but the arrangements of the pixel and the gate line and the data line are not limited thereto. For example, when three pixels PX representing three different colors are configured to form one dot, one data line may be disposed at every three pixel columns.

Hereinafter, a display device according to an exemplary embodiment of the invention in which one data line is disposed at every pixel column will be described. Like elements as the exemplary embodiment described above are identified by like reference numeral and a difference from the above exemplary embodiments will be primarily described in detail.

Figure 17:
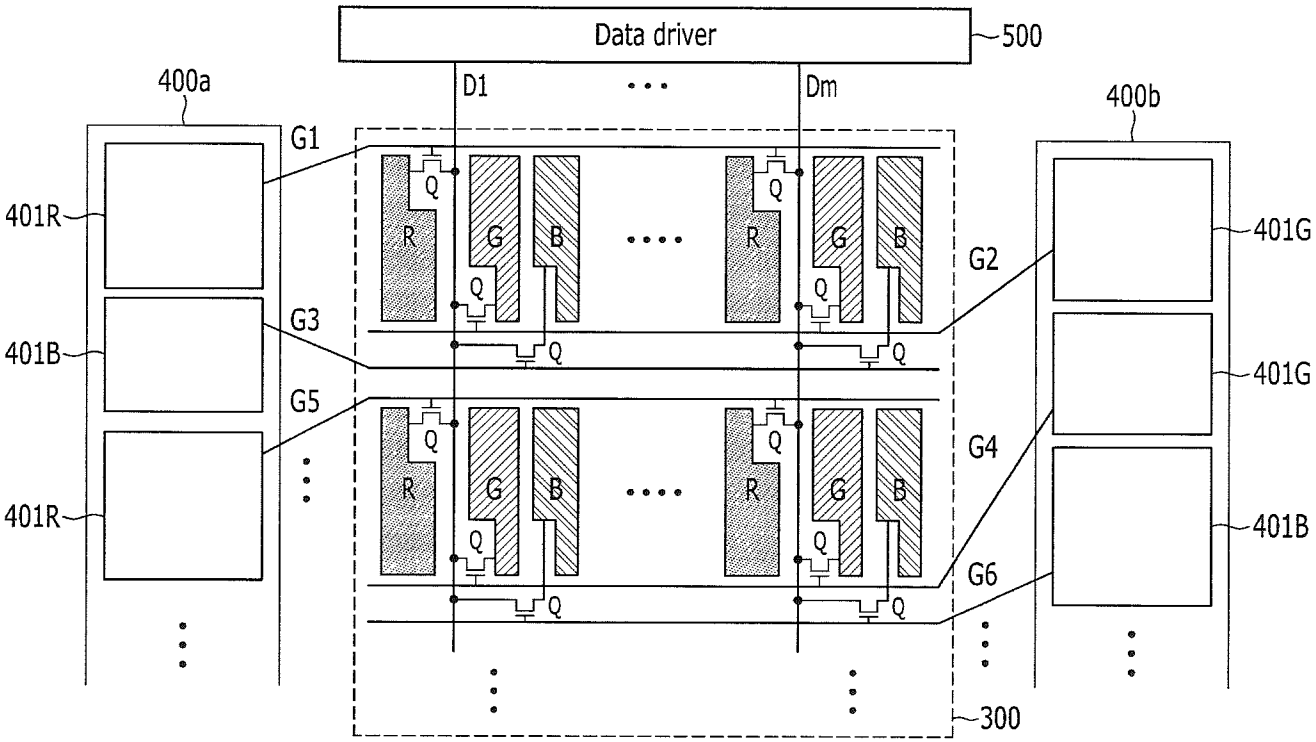
FIGS. 17 to 19 are diagrams illustrating yet alternative exemplary embodiments of a plan view of a pixel and a display signal line of a display device according to the invention.

FIG. 17 is a diagram illustrating an exemplary embodiment of a plan view of a pixel and a display signal line according to the invention.

Referring to FIG. 17, each of a plurality of pixels PX included in a display panel 300 includes a switching element Q, which is connected with gate lines G1, G2, . . . and data lines D1-Dm, and a pixel electrode (not shown) receiving a data voltage from the switching element Q thereof. In the exemplary embodiment, three primary colors of red R, green G, and blue B are used and, for example, the plurality of the pixels PX include a red pixel R representing the red, a green pixel G representing the green, and a blue pixel B representing the blue, wherein the three pixels R, G, and B form one dot.

Referring to FIG. 17, the pixels R, G, and B disposed at one pixel column may represent the same color. A column of the red pixel R, a column of the green pixel G, and a column of the blue pixel B may be alternately disposed in a row direction in sequence.

Further, a length in the column direction of each pixel PX may be larger than a length in the row direction thereof.

Each data line D1, . . . , Dm may be disposed at every one dot column and three gate lines G1, G2, . . . may be disposed at every one pixel row. Accordingly, the red pixel R, the green pixel G, and the blue pixel B included in one dot may be connected to the same data line D1, . . . , Dm and different gate lines G1, G2, . . . through the switching element Q.

The data lines D1, . . . , Dm may be positioned between the red pixel R and the green pixel G, as shown in FIG. 17. Alternatively, the data lines D1, . . . , Dm may be positioned on a left side of the red pixel R, or positioned between the green pixel G and the blue pixel B, or positioned on a right side of the blue pixel B. Further, as shown in FIG. 17, with respect to one pixel row, a gate line corresponding to the red pixels R may be disposed above a corresponding pixel row and gate lines corresponding to the green pixels G and the blue pixels B may be disposed below the corresponding pixel row; however, it should be noted that the invention is not limited thereto. That is, in an alternative embodiment, all the gate lines corresponding to one pixel row may be disposed above or below the corresponding pixel row, or two gate lines corresponding to two primary color pixels may be disposed above the corresponding pixel row and a gate line corresponding to the other remaining primary color pixel may be disposed below the corresponding pixel row.

A first gate driver 400*a* and a second gate driver 400*b* are substantially similar to the exemplary embodiments described above, particularly to the exemplary embodiment shown in FIG. 3. However, in FIG. 17, the gate driving circuit is divided into a gate driving circuit 401R connected with the red pixel R, a gate driving circuit 401G connected with the green pixel G, and a gate driving circuit 401B connected with the blue pixel B.

In an alternative embodiment, unlike as shown in FIG. 17, the gate driving circuit 401R connected with the red pixel R may be disposed at the second gate driver 400*b* and the gate driving circuit 401G connected with the green pixel G may be disposed at the first gate driver 400*a*. In addition, the gate driving circuit 401R connected with the red pixel R and the gate driving circuit 401B connected with the blue pixel B each may be disposed at one of the gate driver 400*a* and 400*b*, respectively, and the gate driving circuit 401G connected with the green pixel G may be alternately disposed at the two gate drivers 400*a* and 400*b*. Similarly, the gate driving circuit 401G connected with the green pixel G and the gate driving circuit 401B connected with the blue pixel B each may be disposed at one of the gate drivers 400*a* and 400*b* respectively, and the gate driving circuit 401R connected with the red pixel R may be alternately disposed at the two gate drivers 400*a* and 400*b*.

In addition, since the arrangements of the gate lines G1, G2, . . . and the gate driving circuits 401R, 401G, and 401B and the output order of data voltages are substantially the same as the exemplary embodiments shown in FIGS. 1 to 15, particularly as the exemplary embodiment shown in FIG. 3, a detailed description thereof is omitted.

Figure 18:
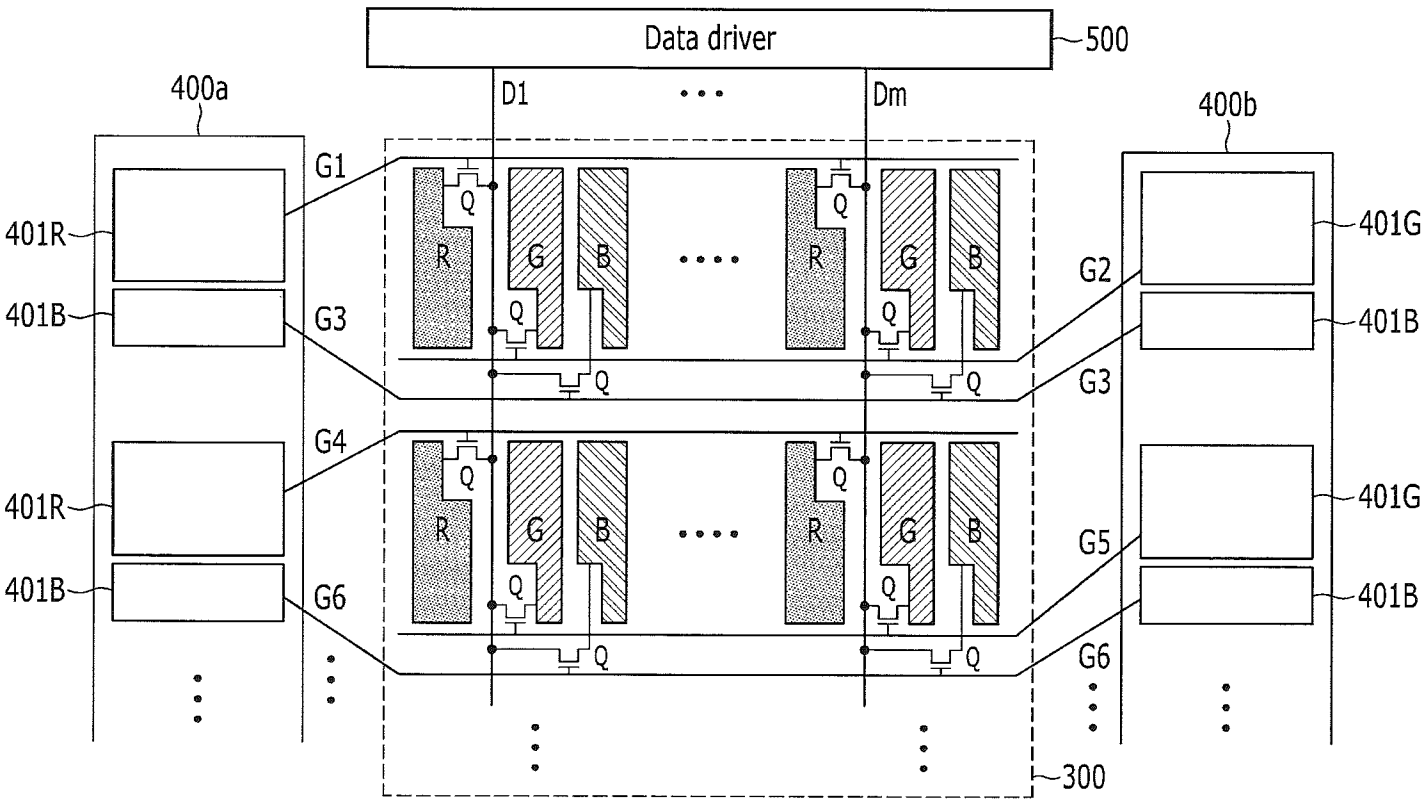
Figure 19:
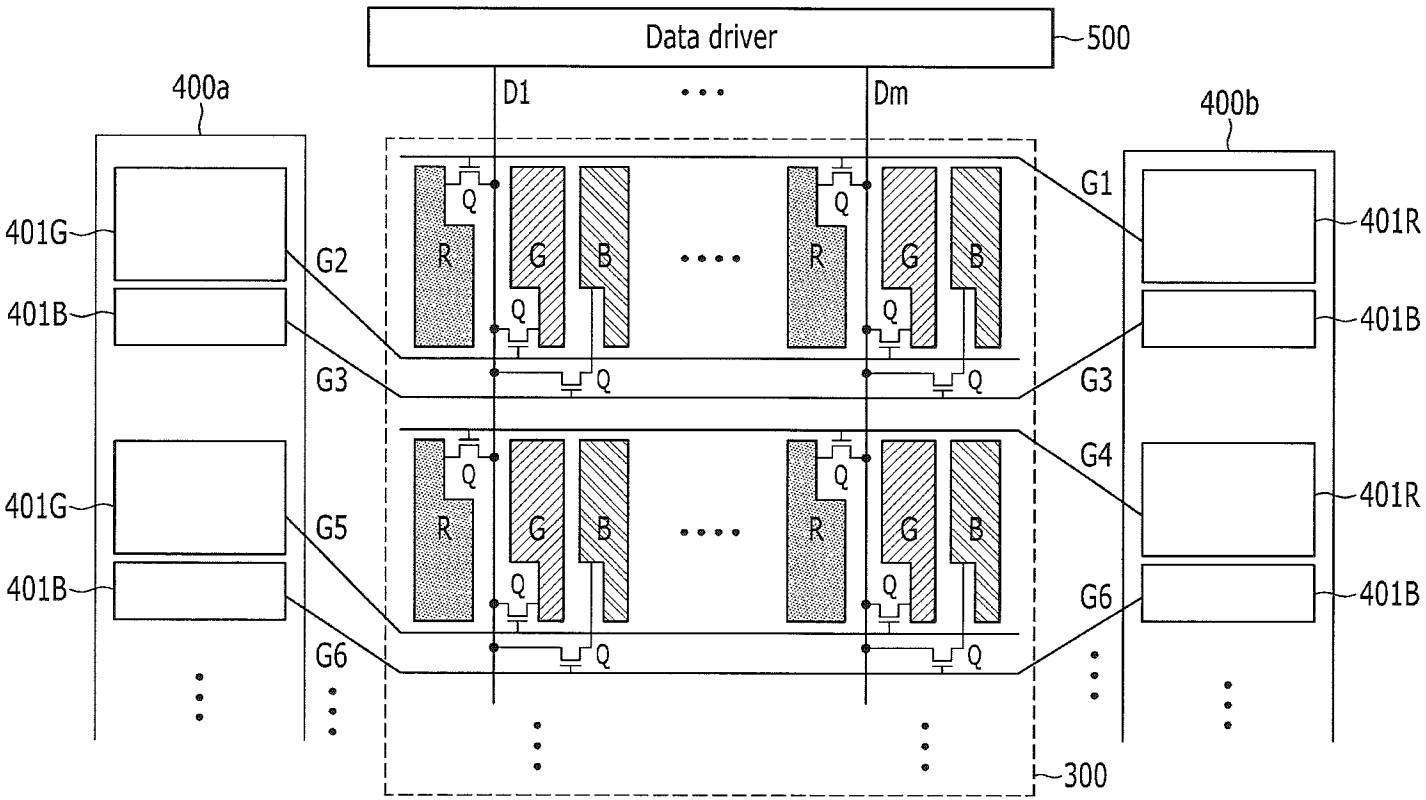

FIGS. 18 and 19 are diagrams illustrating exemplary embodiments of plan views of a pixel and a display signal line of a display device according to the invention.

A display device according to the exemplary embodiment shown in FIG. 18 is substantially similar to the above-described display device shown in FIG. 17. However, in the exemplary embodiment shown in FIG. 18, a connection relationship between the gate lines G3, G6, . . . , connected with the blue pixels B, and the gate driving circuits 401B is different from other exemplary embodiments.

Referring to FIG. 18, gate driving circuits each connected with one of two primary color pixel rows among the red pixels R, the green pixels G, and the blue pixels B are included in different gate drivers 400*a* and 400*b*, respectively, and gate driving circuits connected to the other remaining primary color pixel, may be included in both the gate drivers 400*a* and 400*b*. In particular, as shown in FIG. 18, the gate driving circuits 401R connected with the red pixels R and the gate driving circuits 401G connected with the green pixels G are included in different gate drivers 400*a* and 400*b*, respectively, and gate driving circuits 401B connected with the blue pixels B are included in both the first and the second gate drivers 400*a* and 400*b*, wherein both ends of each of the gate lines G3, G6, . . . , that is connected to the blue pixels B are connected to a pair of corresponding gate driving circuits 401B in both the first and the second gate drivers 400*a* and 400*b*.

Thus, each of the gate lines G3, G6, . . . , which transmit gate signals to the blue pixels B disposed at a corresponding pixel row is connected with the two gate driving circuits 401B disposed at both sides thereof, such that the gate signals may be applied from the two gate driving circuits 401B. Accordingly, there is no difference in a charging ratio between the blue pixels B disposed at the same pixel column, and thus, a display defect such as a horizontal line defect may not occur. In addition, a size of an area corresponding to the gate driving circuits 401B connected to the blue pixels B may be further reduced, such that a size of the display device may be further reduced.

The exemplary embodiment shown in FIG. 19 is substantially similar to the exemplary embodiment shown in FIG. 18 except that positions of the gate driving circuits 401R connected with the red pixels R and the gate driving circuits 401G connected with the green pixels G are reversed. That is, the gate driving circuits 401R connected with the red pixels R may be disposed at the second gate driver 400*b* and the gate driving circuits 401G connected with the green pixels G may be disposed at the first gate driver 400*a*.

In an alternative embodiment, unlike the exemplary embodiments shown in FIGS. 18 and 19, the gate driving circuits 401R connected with the red pixels R and the gate driving circuits 401B connected to the blue pixels B may be disposed at one of the gate drivers 400*a* and 400*b*, respectively, and a pair of the gate driving circuits 401G connected with the green pixels G may be disposed at both the gate drivers 400*a* and 400*b* and are connected to both ends of a corresponding gate line. Similarly, in an alternative embodiment, the gate driving circuits 401G connected with the green pixels G and the gate driving circuits 401B connected to the blue pixels B may be disposed at one of the gate drivers 400*a* and 400*b*, respectively, and a pair of the gate driving circuits 401R may be disposed at both the gate drivers 400*a* and 400*b* and are connected to both ends of a corresponding gate line.

The display device according to the exemplary embodiments of the invention may be implemented as a liquid crystal display, an organic light emitting diode display, an electrophoretic display, or a plasma display, for example, but is not limited thereto.

While the present invention has been particularly shown and described with reference to exemplary embodiments thereof, it will be understood by those of ordinary skill in the art that various changes in form and details may be made therein without departing from the spirit or scope of the present invention as defined by the following claims.

What is claimed is:

1. A display device, comprising:

a display panel including a plurality of pixels arranged in a matrix form, a plurality of gate lines which extend in a row direction, and a plurality of data lines which extend in a column direction and cross the plurality of gate lines;

a first gate driver and a second gate driver which each transmit a gate signal to the plurality of the gate lines and are at edge regions of the display panel which face each other; and a data driver which transmits data voltages to the plurality of the data lines, wherein the plurality of the pixels include a plurality of first color pixels which display a first color, a plurality of second color pixels which display a second color, and a plurality of third color pixels which display a third color, the first through the third colors being different from one another, the plurality of gate lines includes:

first gate lines connected to the first color pixels displaying a same color as each other, second gate lines connected to the second color pixels displaying a same color as each other, and third gate lines connected to the third color pixels displaying a same color as each other, and the first gate lines are connected to the first gate driver, the second gate lines are connected to the second gate driver, and the third gate lines are connected to one of the first gate driver and the second gate driver in an alternate manner in the column direction.

2. The display device of claim 1, wherein the first gate driver includes a plurality of first gate driving circuits sequentially connected to each other in the column direction and which sequentially transmit a gate-on voltage, the second gate driver includes a plurality of second gate driving circuits sequentially connected to each other in the column direction and which sequentially transmit a gate-on voltage, and the plurality of the first gate driving circuits and the plurality of the second gate driving circuits alternately transmit a gate-on voltage.

3. The display device of claim 2, wherein the first, second and third gate lines alternate along the column direction in an order of the first gate line, the second gate line and the third gate line.

4. The display device of claim 3, wherein when k=6j+1 (j=0 or a positive integer), the data driver sequentially applies to the plurality of the data lines data voltages in an order of the first color pixel in a k-th row, the second color pixel in a (k+1)-th row, the first color pixel in a (k+3)-th row, the third color pixel in a (k+2)-th row, the third color pixel in a (k+5)-th row and the second color pixel in a (k+4)-th row.

5. The display device of claim 4, wherein the first gate driving circuits and the second gate driving circuits are integrated to the display panel, and a column direction width of a space on the display panel where the first gate driving circuit or the second gate driving circuit is integrated corresponds to a column direction width of two pixel rows.

6. The display device of claim 2, wherein the first, second and third gate lines alternate along the column direction in an order of the third gate line, the first gate line and the second gate line.

7. The display device of claim 6, wherein when k=6j+1 (j=0 or a positive integer), the data driver sequentially applies to the plurality of the data lines data voltages in an order of the third color pixel in a k-th row, the first color pixel in a (k+1)-th row, the second color pixel in a (k+2)-th row, the third color pixel in a (k+3)-th row, the second color pixel in a (k+5)-th row, and the first color pixel in a (k+4)-th row.

8. The display device of claim 7, wherein the first gate driving circuits and the second gate driving circuits are integrated to the display panel, and a column direction width of a space on the display panel where the first gate driving circuit or the second gate driving circuit is integrated is substantially the same as a column direction width of two pixel rows.

9. The display device of claim 2, wherein the first, second and third gate lines alternate along the column direction in an order of the first gate line, the third gate line and the second gate line.

10. The display device of claim 9, wherein when k=6j+1 (j=0 or a positive integer), the data driver sequentially applies to the plurality of the data lines data voltages in an order of the first color pixel in a k-th row, the third color pixel in a (k+1)-th row, the first color pixel in a (k+3)-th row, the second color pixel in a (k+2)-th row, the third color pixel in a (k+4)-th row, and the second color pixel in a (k+5)-th row.

11. The display device of claim 10, wherein the first gate driving circuits and the second gate driving circuits are integrated to the display panel, and a column direction width of a space on the display panel where the first gate driving circuit or the second gate driving circuit is integrated corresponds to a column direction width of two pixel rows.

12. The display device of claim 1, wherein the third gate line connected with the third color pixel is connected to both the first gate driver and the second gate driver.

13. The display device of claim 1, wherein adjacent data lines of the plurality of the data lines transmit data voltages having different polarities.

14. The display device of claim 13, wherein the pixels include switching elements connected to the gate lines and the data lines, and the switching elements of the plurality of the pixels at one pixel column are alternately connected to different data lines every two pixel rows.

15. The display device of claim 13, wherein the pixels include switching elements connected to the gate lines and the data lines, and the switching elements of the plurality of the pixels at one pixel column are alternately connected to different data lines at every pixel row.

16. A driving method of a display device, the method comprising:

applying a gate-on voltage to a plurality of first color pixels of a display panel which displays a first color, through first gate lines of the display panel which are connected with the first color pixels and extend in a row direction, using a first gate driver at a first edge region of the display panel, all of the first gate lines being connected to the first gate driver;

applying a gate-on voltage to a plurality of second color pixels of the display panel which displays a second color, through second gate lines of the display panel which are connected with the second color pixels and extend in the row direction, using a second gate driver at a second edge region of the display panel, all of the second gate lines being connected to the second gate driver; and applying, alternately or simultaneously, a gate-on voltage to a plurality of third color pixels of the display panel which displays a third color, through third gate lines of the display panel which are connected with the third color pixels and extend in the row direction, using the first gate driver and the second gate driver, the plurality of third color pixels being connected to one of the first gate driver and the second gate driver in an alternate manner in the column direction, wherein the first through the third colors are different from one another, wherein the display panel includes:

a plurality of pixels in a matrix form, a plurality of gate lines which extends in the row direction and includes:

the first gate lines connected to the first color pixels displaying a same color as each other, the second gate lines connected to the first color pixels displaying a same color as each other, and the third gate lines connected to the first color pixels displaying a same color as each other, a plurality of data lines which extend in a column direction and cross the plurality of gate lines;

the first gate driver and the second gate driver which each transmit a gate signal to the plurality of the gate lines and are at the first and second edge regions which face each other; and a data driver which transmits data voltages to the plurality of the data lines.

17. The method of claim 16, wherein the first gate driver includes a plurality of first gate driving circuits sequentially connected to each other in the column direction and which sequentially transmit the gate-on voltage, the second gate driver includes a plurality of second gate driving circuits sequentially connected to each other in the column direction and which sequentially transmit the gate-on voltage, and the plurality of the first gate driving circuits and the plurality of the second gate driving circuits transmit the gate-on voltage in turn.

18. The method of claim 17, wherein the first, second and third gate lines alternate along the column direction in an order of the first gate line, the second gate line and the third gate line, and the method further comprises:

sequentially applying, when k=6j+1 (j=0 or a positive integer), to the plurality of the data lines data voltages in an order of the first color pixel in a k-th row, the second color pixel in a (k+1)-th row, the first color pixel in a (k+3)-th row, the third color pixel in a (k+2)-th row, the third color pixel in a (k+5)-th row and the second color pixel in a (k+4)-th row, using the data driver.

19. The method of claim 17, wherein the first, second and third gate lines alternate along the column direction in an order of the third gate line, the first gate line and the second gate line, and the method further comprises:

sequentially applying, when k=6j+1 (j=0 or a positive integer), to the plurality of the data lines data voltages in an order of the third color pixel in a k-th row, the first color pixel in a (k+1)-th row, the second color pixel in a (k+2)-th row, the third color pixel in a (k+3)-th row, the second color pixel in a (k+5)-th row and the first color pixel in a (k+4)-th row, using the data driver.

20. The method of claim 17, wherein the first, second and third gate lines alternate along the column direction in an order of the first gate line, the third gate line and the second gate line, and the method further comprises:

sequentially applying, when k=6j+1 (j=0 or a positive integer), to the plurality of the data lines data voltages in an order of the first color pixel in a k-th row, the third color pixel in a (k+1)-th row, the first color pixel in a (k+3)-th row, the second color pixel in a (k+2)-th row, the third color pixel in a (k+4)-th row, and the second color pixel in a (k+5)-th row, using the data driver.

21. The method of claim 16, wherein:

adjacent data lines of the plurality of the data lines transmit data voltages having different polarities.

22. The method of claim 21, wherein the pixels include switching elements connected to the gate lines and the data lines, and the switching elements of the plurality of the pixels at one pixel column are alternately connected to different data lines every two pixel rows.

23. The method of claim 21, wherein the pixels include switching elements connected to the gate lines and the data lines, and the switching elements of the plurality of the pixels at one pixel column are alternately connected to different data lines at every pixel row.

* * * * *